US010202977B2

(12) United States Patent
Nishikawa

(10) Patent No.: US 10,202,977 B2
(45) Date of Patent: Feb. 12, 2019

(54) VANE PUMP DEVICE HAVING DIFFERENT DISCHARGING PRESSURES

(71) Applicant: Showa Corporation, Gyoda-shi (JP)

(72) Inventor: Toshio Nishikawa, Haga-gun (JP)

(73) Assignee: SHOWA CORPORATION, Gyoda-Shi (JP)

( * ) Notice: Subject to any disclaimer, the term of this patent is extended or adjusted under 35 U.S.C. 154(b) by 18 days.

(21) Appl. No.: 15/376,062

(22) Filed: Dec. 12, 2016

(65) Prior Publication Data

US 2017/0175740 A1 Jun. 22, 2017

(30) Foreign Application Priority Data

Dec. 16, 2015 (JP) ..... 2015-245695

(51) Int. Cl.

| | |
|---|---|
| ***F04C 29/12*** | (2006.01) |
| ***F04C 18/344*** | (2006.01) |
| ***F04C 14/02*** | (2006.01) |
| ***F04C 14/24*** | (2006.01) |
| ***F04C 15/06*** | (2006.01) |

(Continued)

(52) U.S. Cl.

CPC ..... *F04C 15/06* (2013.01); *F04C 2/3448* (2013.01); *F04C 13/001* (2013.01); *F04C 2210/206* (2013.01); *F04C 2240/30* (2013.01)

(58) Field of Classification Search

CPC ..... F04C 2/348; F04C 2/3442; F04C 2/3446; F04C 14/24; F04C 14/02; F04C 29/12

USPC ..... 418/77, 81–82, 133, 188, 259–260, 266, 418/268, 150

See application file for complete search history.

(56) References Cited

U.S. PATENT DOCUMENTS 2,990,109 A * 6/1961 Fraser ..... F04C 2/344 418/149
3,752,605 A * 8/1973 Newton ..... F04C 28/22 418/13

(Continued)

FOREIGN PATENT DOCUMENTS

CN 104471251 A 10/2011
CN 203335393 U 12/2013

(Continued)

OTHER PUBLICATIONS

Chinese Office Action dated Nov. 26, 2018 for Chinese Application No. 201611168137.3.

*Primary Examiner* — Mark Laurenzi
*Assistant Examiner* — Deming Wan
(74) *Attorney, Agent, or Firm* — Leason Ellis LLP

(57) ABSTRACT

An embodiment provides a vane pump device includes a pump unit that includes a high pressure side discharge through-hole which discharges oil at a first discharge pressure, and a low pressure side discharge through-hole which discharges oil at a second discharge pressure lower than the first discharge pressure; and a housing which accommodates the pump unit, and includes a high pressure side discharge outlet through which oil discharged from the high pressure side discharge through-hole of the pump unit is discharged to the outside, and a low pressure side discharge outlet through which oil discharged from the low pressure side discharge through-hole is discharged to the outside, and in which the high pressure side discharge outlet and the low pressure side discharge outlet are formed to face the same direction.

9 Claims, 20 Drawing Sheets

(51) Int. Cl.
*F04C 2/344* (2006.01)
*F04C 13/00* (2006.01)

(56) References Cited

U.S. PATENT DOCUMENTS

| | | | | |
|---|---|---|---|---|
| 4,183,723 | A * | 1/1980 | Hansen | F04C 14/02 417/204 |
| 2003/0044300 | A1 * | 3/2003 | Osugi | F01C 21/0827 418/260 |
| 2013/0052073 | A1 | 2/2013 | Ishihama et al. | |
| 2015/0147216 | A1 | 5/2015 | Shimaguchi et al. | |

FOREIGN PATENT DOCUMENTS

| | | | |
|---|---|---|---|
| JP | 2011-196302 | A | 10/2011 |
| JP | 2013-050067 | A | 3/2013 |

* cited by examiner

VANE PUMP DEVICE HAVING DIFFERENT DISCHARGING PRESSURES

CROSS-REFERENCE TO RELATED APPLICATION(S)

This application claims priority from Japanese Patent Application No. 2015-245695 filed on Dec. 16, 2015, the entire contents of which are incorporated herein by reference.

BACKGROUND

1. Field

The present invention relates to a vane pump device.

2. Description of Related Art

For example, in a vane pump disclosed in JP-A-2013-50067, discharge ports are respectively provided at two positions which face each other in a diameter direction passing through the center of a rotor, one of the two discharge ports is referred to as a main discharge port, and the other is referred to as a sub-discharge port. The main discharge port is connected to a discharge passage and a discharge outlet so as to normally supply discharged oil to a fluid device. The sub-discharge port communicates with the discharge passage and the discharge outlet via a communication passage.

JP-A-2011-196302 discloses a vane pump including a switching valve that switches between a full discharge position at which a working fluid is suctioned and discharged in both main and sub regions and a half-discharge position at which the working fluid is suctioned and discharged only in the main region. The switching valve switches the pressure of the working fluid introduced to vanes in the sub region such that the vanes retract to the rotor and move away from the inner circumferential cam surface of the cam ring at the half-discharge position.

Since a vane pump device which discharges a working fluid at multiple discharge pressures includes multiple discharge outlets through which the working fluid is discharged, multiple guide members (pipes, tubes, or the like), which guide the discharged working fluid to other devices, are required to be connected to the discharge outlets in such a way that at least one guide member is connected to one discharge port.

SUMMARY

According to an aspect of the present invention, there is provided a vane pump device including: a pump unit that includes a first discharge portion which discharges a working fluid at a first discharge pressure, and a second discharge portion which discharges the working fluid at a second discharge pressure lower than the first discharge pressure; and a housing which accommodates the pump unit, and includes a first discharge outlet through which the working fluid discharged from the first discharge portion of the pump unit is discharged to the outside, and a second discharge outlet through which the working fluid discharged from the second discharge portion is discharged to the outside, and in which the first discharge outlet and the second discharge outlet are formed to face the same direction.

According to the present invention, it is possible to provide a vane pump device in which members can be easily connected to discharge outlets.

DESCRIPTION OF EMBODIMENTS

Hereinafter, an embodiment will be described in detail with reference to the accompanying drawings.

Figure 1:
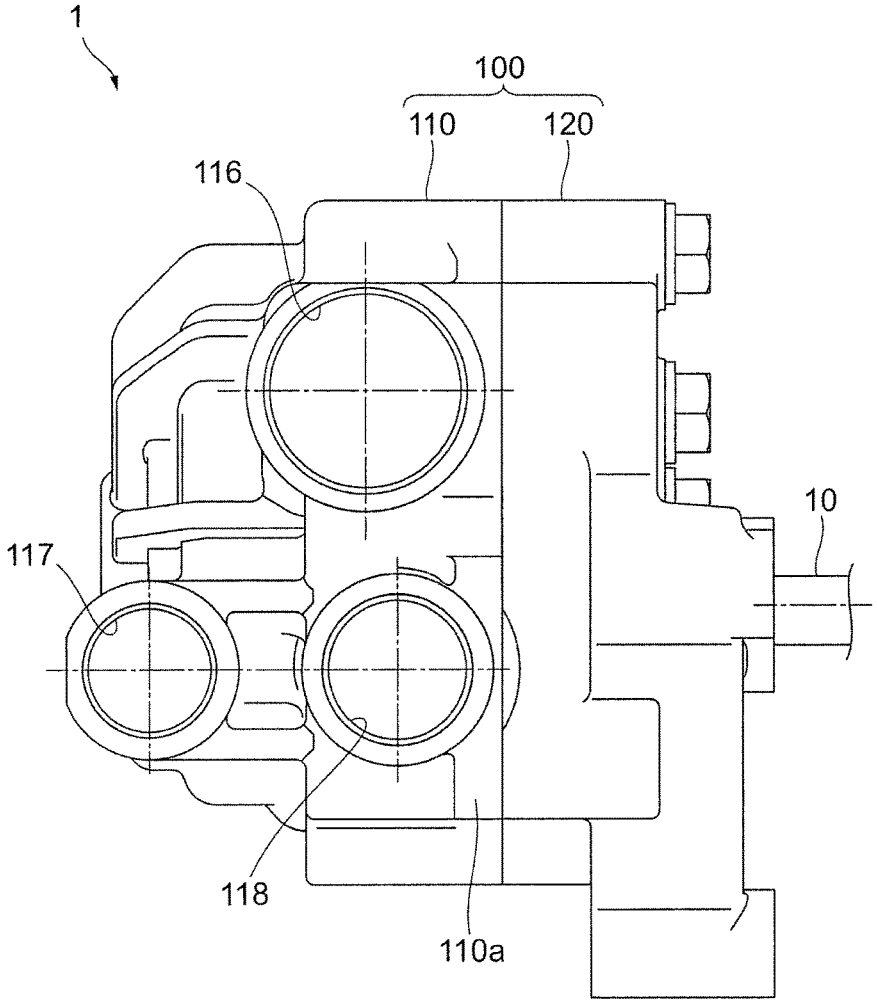
FIG. 1 is an exterior view of a vane pump in an embodiment.

FIG. 1 is an exterior view of a vane pump device 1 (hereinafter, referred to as a "vane pump 1") in the embodiment.

Figure 2:
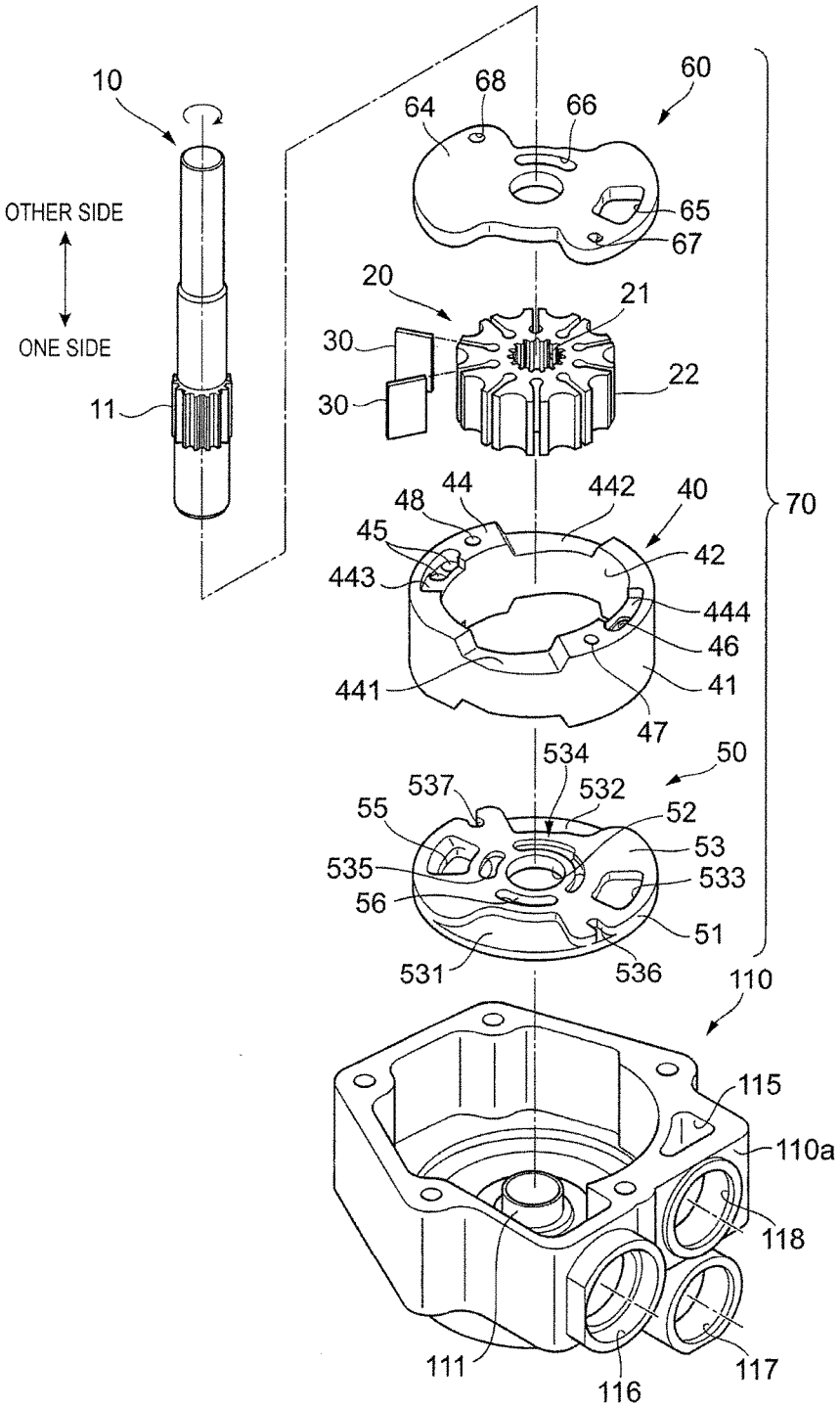
FIG. 2 is a perspective view illustrating a portion of configuration components of the vane pump viewed from a cover side.

FIG. 2 is a perspective view illustrating a portion of configuration components of the vane pump 1 viewed from a cover 120 side.

Figure 3:
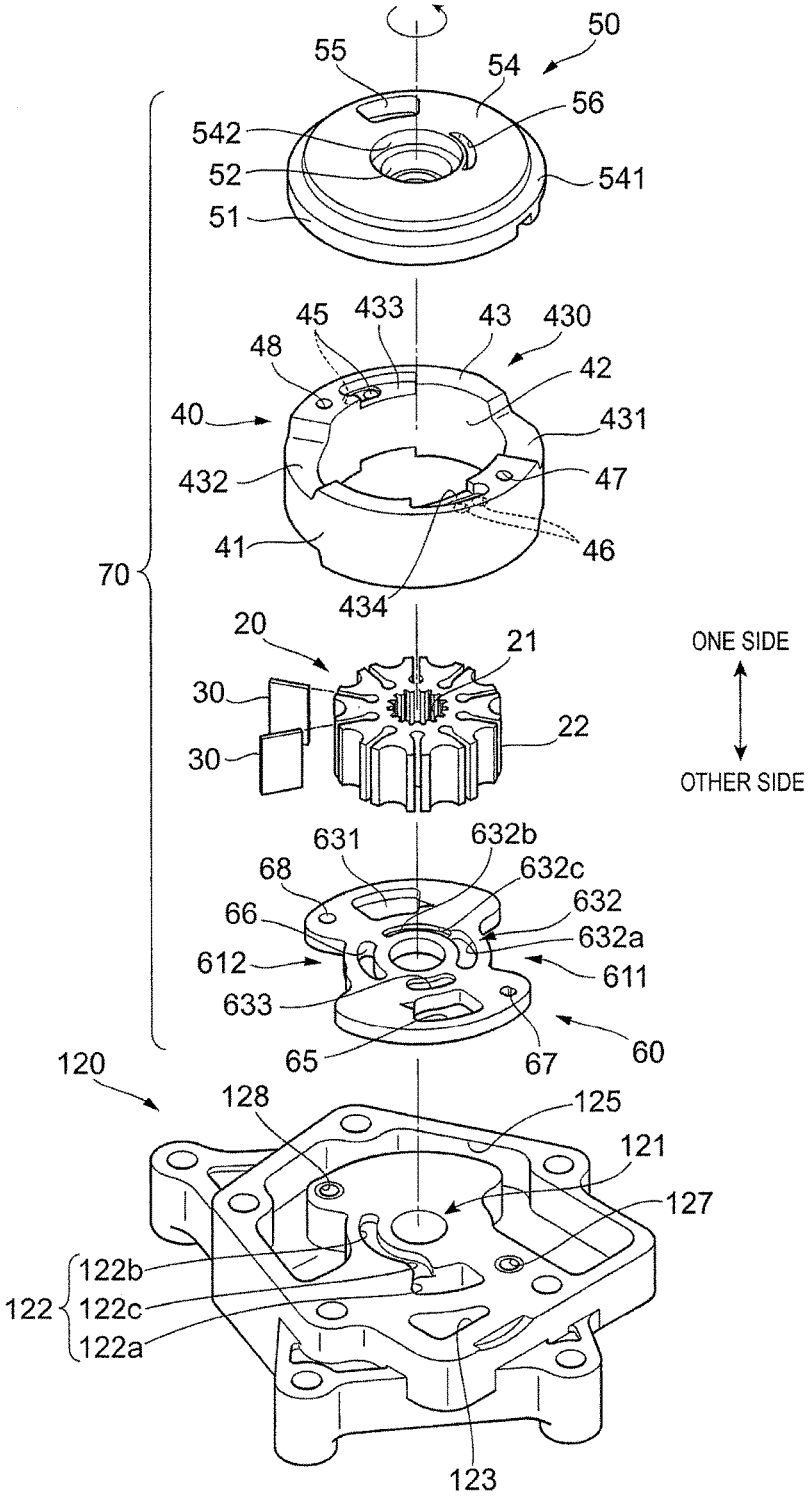
FIG. 3 is a perspective view illustrating a portion of configuration components of the vane pump viewed from a case side.

FIG. 3 is a perspective view illustrating a portion of configuration components of the vane pump 1 viewed from a case 110 side.

Figure 4:
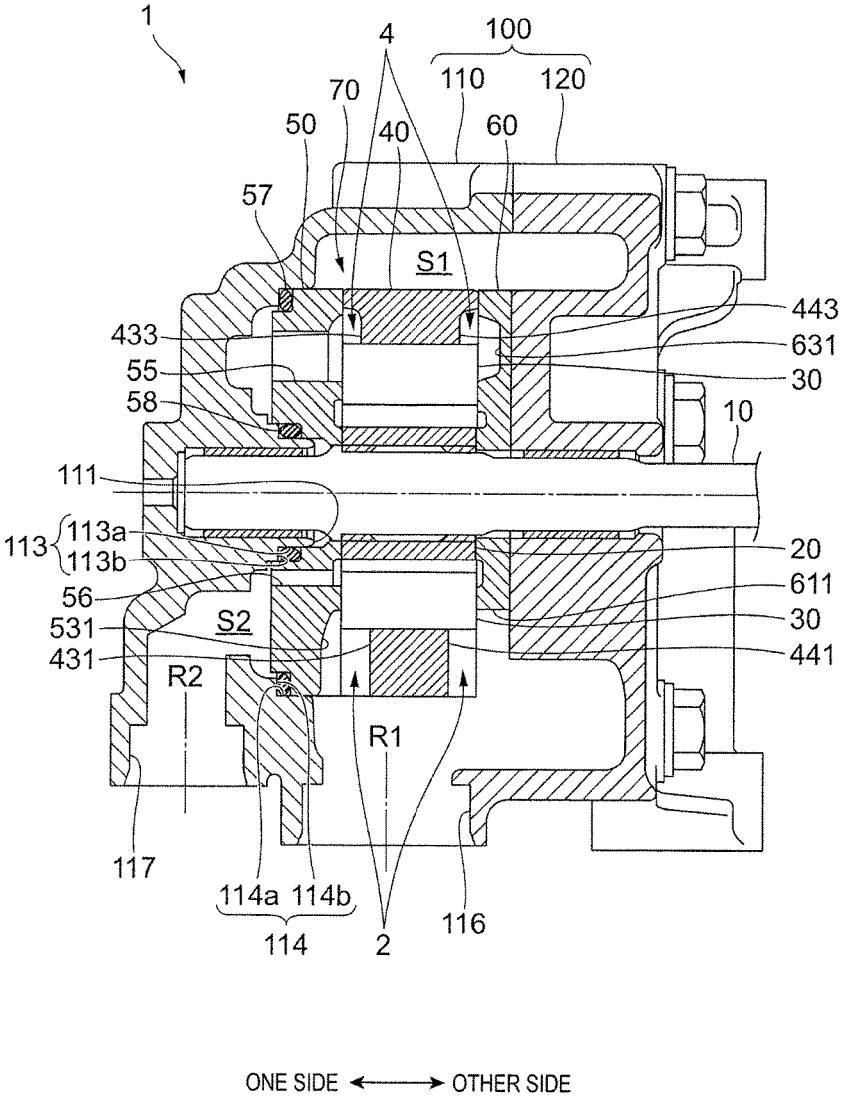
FIG. 4 is a sectional view illustrating a flow path of high pressure oil of the vane pump.

FIG. 4 is a sectional view illustrating a flow path of high pressure oil of the vane pump 1. FIG. 4 is a sectional view taken along line IV-IV in FIG. 6A.

Figure 5:
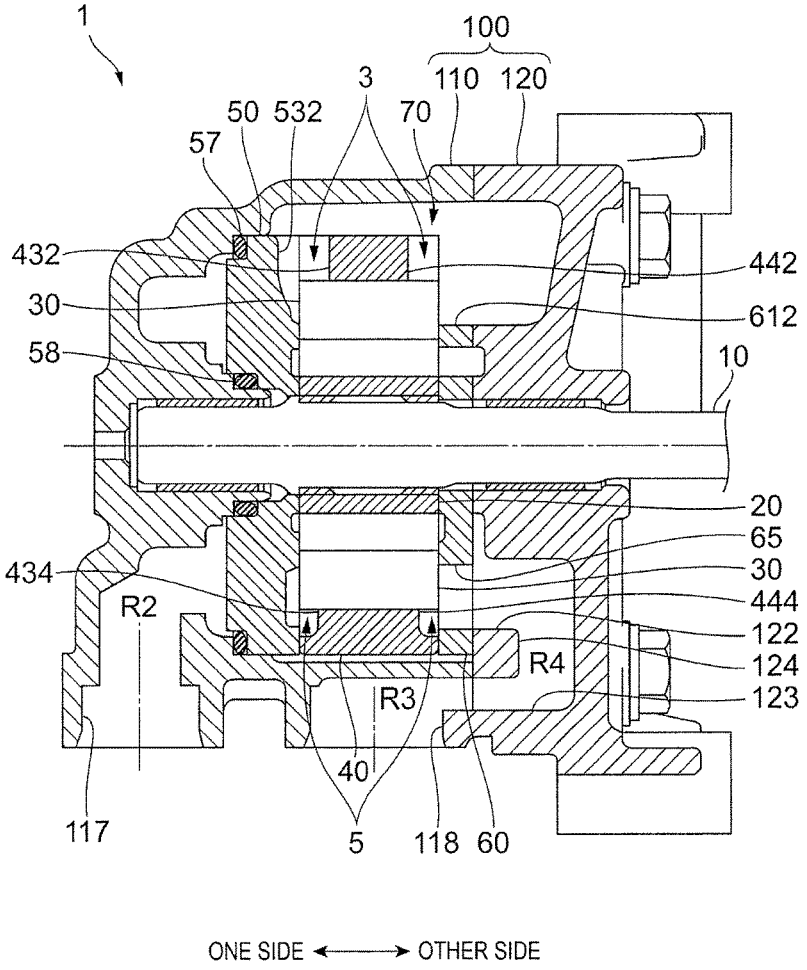
FIG. 5 is a sectional view illustrating a flow path of low pressure oil of the vane pump.
Figure 6B:
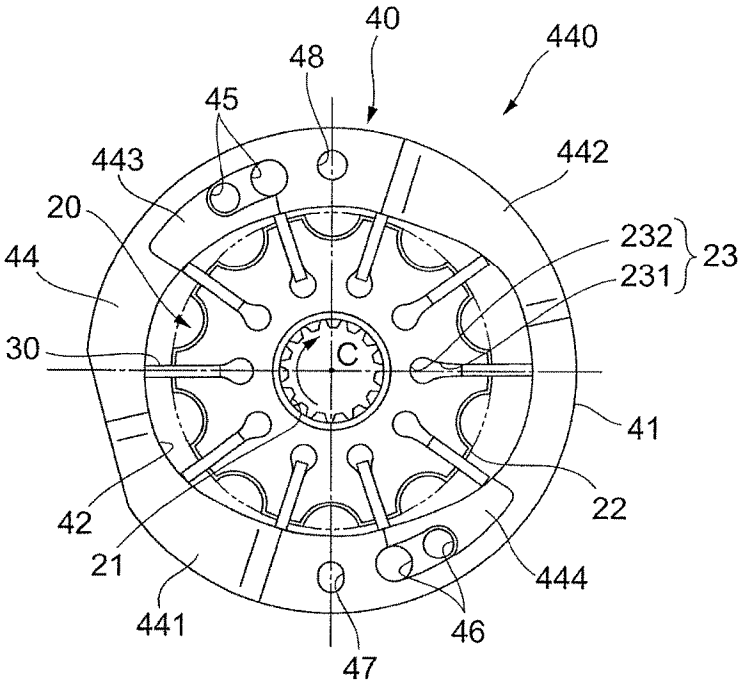
FIG. 6B is a view illustrating the rotor, the vanes, and the cam ring viewed from the other side in the direction of the rotation axis.
Figure 6A:
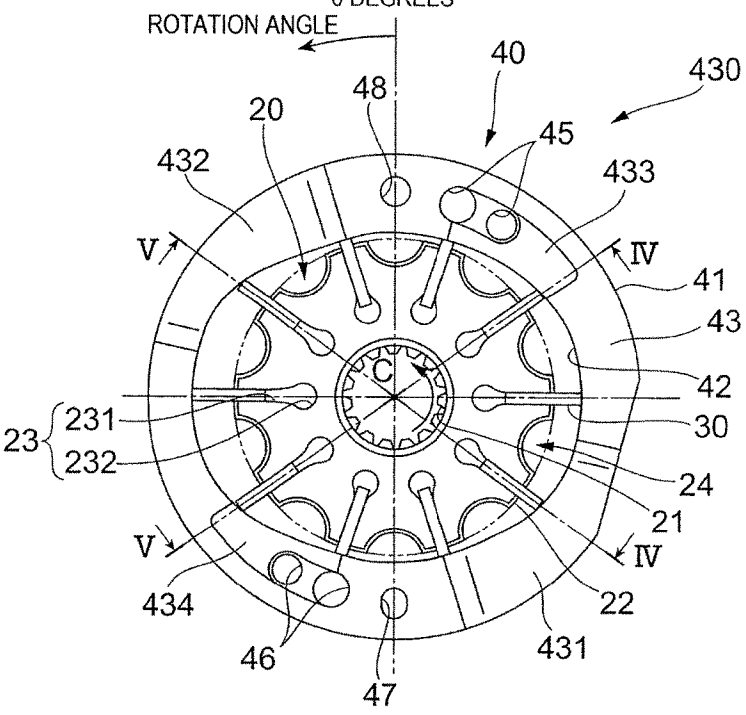
FIG. 6A is a view illustrating a rotor, vanes, and a cam ring viewed from one side in the direction of a rotation axis.

FIG. 5 is a sectional view illustrating a flow path of low pressure oil of the vane pump 1 FIG. 5 is a sectional view taken along line V-V in FIG. 6A.

The vane pump 1 is a pump that is driven by power of an engine of a vehicle, and supplies oil, an example of a working fluid, to apparatuses such as a hydraulic continuously variable transmission and a hydraulic power steering apparatus.

The vane pump 1 in the embodiment increases the pressure of oil, which is suctioned from one suction inlet 116, to two different pressures, and discharges oil having a high pressure between the two pressures from a high pressure side discharge outlet 117, and low pressure oil from a low pressure side discharge outlet 118. More specifically, the vane pump 1 in the embodiment increases the pressure of oil inside a pump chamber, which is suctioned from the suction inlet 116 and then is suctioned into the pump chamber from a high pressure side suction port 2 (refer to FIG. 4), and discharges the pressurized oil from a high pressure side discharge port 4 (refer to FIG. 4) and then to the outside from the high pressure side discharge outlet 117. In addition, the vane pump 1 increases the pressure of oil inside a pump chamber, which is suctioned from the suction inlet 116 and then is suctioned into a pump chamber from a low pressure side suction port 3 (refer to FIG. 5), and discharges the pressurized oil from a low pressure side discharge port 5 (refer to FIG. 5) and then to the outside from the low pressure side discharge outlet 118. The high pressure side suction port 2, the low pressure side suction port 3, the high pressure side discharge port 4, and the low pressure side discharge port 5 are a portion of the vane pump 1 which faces the pump chamber.

In the vane pump 1 of the embodiment, the volume of the pump chamber, to which oil having a high pressure between the two different pressures is suctioned, is smaller than that of the pump chamber to which oil having a low pressure between the two different pressures is suctioned. That is, the high pressure side discharge outlet 117 discharges a small amount of high pressure oil, and the low pressure side discharge outlet 118 discharges a large amount of low pressure oil.

The vane pump 1 includes a rotation shaft 10 that rotates due to a drive force received from the engine or a motor of the vehicle; a rotor 20 that rotates along with the rotation shaft 10; multiple vanes 30 that are respectively assembled into grooves formed in the rotor 20; and a cam ring 40 that surrounds an outer circumference of the rotor 20 and the vanes 30.

The vane pump 1 includes an inner plate 50 that is an example of one side member and is disposed closer to one end portion side of the rotation shaft 10 than the cam ring 40, and an outer plate 60 that is an example of another side member and is disposed closer to the other end portion side of the rotation shaft 10 than the cam ring 40. In the vane pump 1 of the embodiment, a pump unit 70 includes the rotor 20, 10 vanes 30, the cam ring 40, the inner plate 50, and the outer plate 60. The pump unit 70 increases the pressure of oil suctioned into pump chambers, and discharges the pressurized oil.

The vane pump 1 includes a housing 100 that accommodates the rotor 20; the multiple vanes 30; the cam ring 40; the inner plate 50; and the outer plate 60. The housing 100 includes the bottomed cylindrical case 110, and the cover 120 that covers an opening of the case 110.

<Configuration of Rotation Shaft 10>

The rotation shaft 10 is rotatably supported by a case bearing 111 (to be described later) provided in the case 110, and a cover bearing 121 (to be described later) provided in the cover 120. A spline 11 is formed on an outer circumferential surface of the rotation shaft 10, and the rotation shaft 10 is connected to the rotor 20 via the spline 11. In the embodiment, the rotation shaft 10 receives power from a drive source, for example, the engine of the vehicle, disposed outside of the vane pump 1 such that the rotation shaft 10 rotates and drives rotation of the rotor 20 via the spline 11.

In the vane pump 1 of the embodiment, the rotation shaft 10 (the rotor 20) is configured to rotate in a clockwise direction as illustrated in FIG. 2.

<Configuration of Rotor 20>

FIG. 6A is a view illustrating the rotor 20, the vanes 30, and the cam ring 40 viewed from one side in the direction of a rotation axis. FIG. 6B is a view illustrating the rotor 20, the vanes 30, and the cam ring 40 viewed from the other side in the direction of the rotation axis.

The rotor 20 is a substantially cylindrical member. A spline 21 is formed on an inner circumferential surface of the rotor 20, and is fitted to the spline 11 of the rotation shaft 10. Multiple (10 in the embodiment) vane grooves 23 accommodating the vanes 30 are formed in an outer circumferential portion of the rotor 20 such that the multiple vane grooves 23 are recessed from an outermost circumferential surface 22 toward a rotation center and are equally spaced apart from each other in a circumferential direction (radially). A recess portion 24 is formed in the outer circumferential portion of the rotor 20 such that the recess portion 24 is recessed from the outermost circumferential surface 22 toward the rotation center and is disposed between two adjacent vane grooves 23.

Each of the vane grooves 23 is a groove that opens in the outermost circumferential surface 22 of the rotor 20 and both end surfaces in the direction of the rotation axis of the rotation shaft 10. As illustrated in FIGS. 6A and 6B, when viewed in the direction of the rotation axis, an outer circumferential portion side of the vane groove 23 has a rectangular shape in which the radial direction of rotation coincides with a longitudinal direction of the rectangular shape, and a portion of the vane groove 23 close to the rotation center has a circular shape having a diameter larger than the length of the rectangular shape in a lateral direction of the rectangular shape. That is, the vane groove 23 includes a rectangular parallelepiped groove 231 that is formed into a rectangular parallelepiped shape on the outer circumferential portion side, and a columnar groove 232 as an example of a center side space which is formed into a columnar shape and is positioned close to the rotation center.

<Configuration of Vane 30>

The vane 30 is a rectangular parallelepiped member, and the vanes 30 are respectively assembled into the vane grooves 23 of the rotor 20. The length of the vane 30 in the radial direction of rotation is shorter than that of the vane groove 23 in the radial direction of rotation, and the width of the vane 30 is narrower than that of the vane groove 23. The vane 30 is held in the vane groove 23 such that the vane 30 is capable of moving in the radial direction of rotation.

<Configuration of Cam Ring 40>

The cam ring 40 has a substantially cylindrical member, and includes an outer circumferential cam ring surface 41; an inner circumferential cam ring surface 42; an inner end surface 43 that is an end surface positioned toward the inner plate 50 in the direction of the rotation axis; and an outer end surface 44 that is an end surface positioned toward the outer plate 60 in the direction of the rotation axis.

As illustrated in FIGS. 6A and 6B, when viewed in the direction of the rotation axis, the outer circumferential cam ring surface 41 has a substantially circular shape in which a distance from the rotation center to any point on the entire circumference (excluding a portion of the circumference) is substantially the same.

Figure 7:
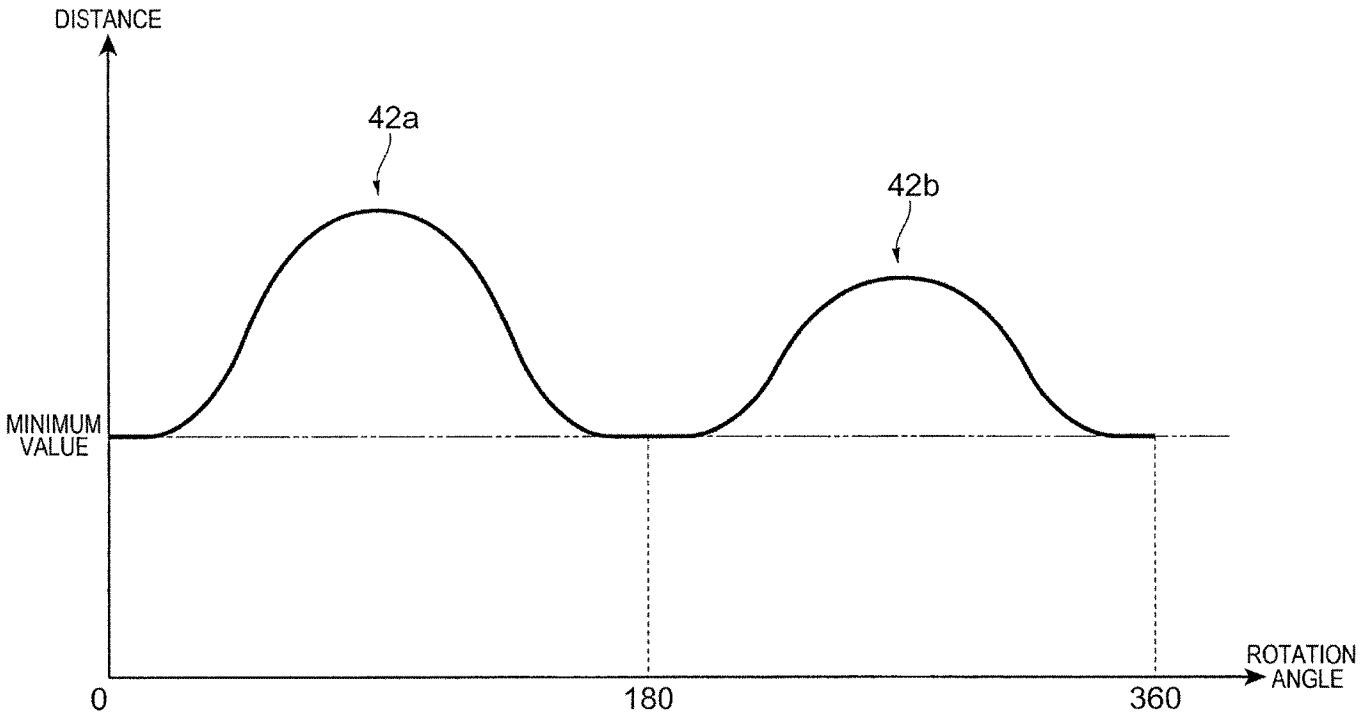
FIG. 7 is a graph illustrating a distance from a rotation center to an inner circumferential cam ring surface of the cam ring at each rotational angular position.

FIG. 7 is a graph illustrating a distance from the rotation center to the inner circumferential cam ring surface 42 of the cam ring 40 at each rotational angular position.

As illustrated in FIG. 7, when viewed in the direction of the rotation axis, the inner circumferential cam ring surface 42 of the cam ring 40 is formed to have two protrusions, of which the distance (in other words, the amount of protrusion of the vane 30 from the vane groove 23) from a rotation center C (refer to FIG. 6) is different from that at other rotational angular positions. That is, in a case where a positive vertical axis in FIG. 6A is assumed to be positioned at zero degrees, the distance from the rotation center C is set such that a first protrusion 42*a* is formed by gradually increasing the distance in a range between approximately 20 degrees and approximately 90 degrees in a counterclockwise direction and gradually decreasing the distance in a range between approximately 90 degrees and approximately 160 degrees, and a second protrusion 42*b* is formed by gradually increasing the distance in a range between approximately 200 degrees and approximately 270 degrees and gradually decreasing the distance in a range between approximately 270 degrees and approximately 340 degrees. As illustrated in FIG. 7, in the cam ring 40 of the embodiment, the distance from the rotation center C at each rotational angular position is set such that the amount of protrusion of the first protrusion 42*a* is greater than that of the second protrusion 42*b*. In addition, the distance from the rotation center C at each rotational angular position is set such that a base of the second protrusion 42*b* is smoother than that of the first protrusion 42*a*. That is, a change of the distance from the rotation center C to the base of the second protrusion 42*b* at each rotational angular position is less than a change of the distance from the rotation center C to the base of the first protrusion 42*a* at each rotational angular position. The distance from the rotation center C to portions other than the protrusions is set to be the minimum value. The minimum value is set to be slightly greater than the distance from the rotation center C to the outermost circumferential surface 22 of the rotor 20.

As illustrated in FIG. 6A, the cam ring 40 includes an inner recess portion 430 made up of multiple recess portions which are recessed from the inner end surface 43. As illustrated in FIG. 6B, the cam ring 40 includes an outer recess portion 440 made up of multiple recess portions which are recessed from the outer end surface 44.

As illustrated in FIG. 6A, the inner recess portion 430 includes a high pressure side suction recess portion 431 forming the high pressure side suction port 2; a low pressure side suction recess portion 432 forming the low pressure side suction port 3; a high pressure side discharge recess portion 433 forming the high pressure side discharge port 4; and a low pressure side discharge recess portion 434 forming the low pressure side discharge port 5. When viewed in the direction of the rotation axis, the high pressure side suction recess portion 431 and the low pressure side suction recess portion 432 are formed to be point-symmetrical with each other with respect to the rotation center C, and the high pressure side discharge recess portion 433 and the low pressure side discharge recess portion 434 are formed to be point-symmetrical with each other with respect to the rotation center C. The high pressure side suction recess portion 431 and the low pressure side suction recess portion 432 are recessed over the entire region of the inner end surface 43 in the radial direction of rotation. In addition, the high pressure side suction recess portion 431 and the low pressure side suction recess portion 432 are recessed from the inner end surface 43 at a predetermined angle in the circumferential direction. The high pressure side discharge recess portion 433 and the low pressure side discharge recess portion 434 are recessed from a predetermined region of the inner end surface 43 in the radial direction of rotation which is positioned between the inner circumferential cam ring surface 42 and the outer circumferential cam ring surface 41. In addition, the high pressure side discharge recess portion 433 and the low pressure side discharge recess portion 434 are recessed from the inner end surface 43 at a predetermined angle in the circumferential direction.

As illustrated in FIG. 6B, the outer recess portion 440 includes a high pressure side suction recess portion 441 forming the high pressure side suction port 2; a low pressure side suction recess portion 442 forming the low pressure side suction port 3; a high pressure side discharge recess portion 443 forming the high pressure side discharge port 4; and a low pressure side discharge recess portion 444 forming the low pressure side discharge port 5. When viewed in the direction of the rotation axis, the high pressure side suction recess portion 441 and the low pressure side suction recess portion 442 are formed to be point-symmetrical with each other with respect to the rotation center C, and the high pressure side discharge recess portion 443 and the low pressure side discharge recess portion 444 are formed to be point-symmetrical with each other with respect to the rotation center C. The high pressure side suction recess portion 441 and the low pressure side suction recess portion 442 are recessed over the entire region of the outer end surface 44 in the radial direction of rotation. In addition, the high pressure side suction recess portion 441 and the low pressure side suction recess portion 442 are recessed from the outer end surface 44 at a predetermined angle in the circumferential direction. The high pressure side discharge recess portion 443 and the low pressure side discharge recess portion 444 are recessed from a predetermined region of the outer end surface 44 in the radial direction of rotation which is positioned between the inner circumferential cam ring surface 42 and the outer circumferential cam ring surface 41. In addition, the high pressure side discharge recess portion 443 and the low pressure side discharge recess portion 444 are recessed from the outer end surface 44 at a predetermined angle in the circumferential direction.

When viewed in the direction of the rotation axis, the high pressure side suction recess portion 431 and the high pressure side suction recess portion 441 are provided at the same position, and the low pressure side suction recess portion 432 and the low pressure side suction recess portion 442 are provided at the same position. In a case where the positive vertical axis in FIG. 6A is assumed to be positioned at zero degrees, the low pressure side suction recess portion 432 and the low pressure side suction recess portion 442 are provided in a range between approximately 20 degrees and approximately 90 degrees in the counterclockwise direction, and the high pressure side suction recess portion 431 and the high pressure side suction recess portion 441 are provided in a range between approximately 200 degrees and approximately 270 degrees.

When viewed in the direction of the rotation axis, the high pressure side discharge recess portion 433 and the high pressure side discharge recess portion 443 are provided at the same position, and the low pressure side discharge recess portion 434 and the low pressure side discharge recess portion 444 are provided at the same position. In a case where the positive vertical axis in FIG. 6A is assumed to be positioned at zero degrees, the low pressure side discharge recess portion 434 and the low pressure side discharge recess portion 444 are provided in a range between approximately 130 degrees and approximately 175 degrees in the counterclockwise direction, and the high pressure side discharge recess portion 433 and the high pressure side discharge recess portion 443 are provided in a range between approximately 310 degrees and approximately 355 degrees.

Two high pressure side discharge through-holes 45 are formed to pass through the cam ring 40 in the direction of the rotation axis such that the high pressure side discharge recess portion 433 communicates with the high pressure side discharge recess portion 443 via the two high pressure side discharge through-holes 45. Two low pressure side discharge through-holes 46 are formed to pass through the cam ring 40 in the direction of the rotation axis such that the low pressure side discharge recess portion 434 communicates with the low pressure side discharge recess portion 444 via the two low pressure side discharge through-holes 46.

A first through-hole 47 is formed to pass through the cam ring 40 in the direction of the rotation axis such that the inner end surface 43 between the high pressure side suction recess portion 431 and the low pressure side discharge recess portion 434 communicates with the outer end surface 44 between the high pressure side suction recess portion 441 and the low pressure side discharge recess portion 444 via the first through-hole 47. In addition, a second through-hole 48 is formed to pass through the cam ring 40 in the direction of the rotation axis such that the inner end surface 43 between the low pressure side suction recess portion 432 and the high pressure side discharge recess portion 433 communicates with the outer end surface 44 between the low pressure side suction recess portion 442 and the high pressure side discharge recess portion 443 via the second through-hole 48.

<Configuration of Inner Plate 50>

Figure 8B:
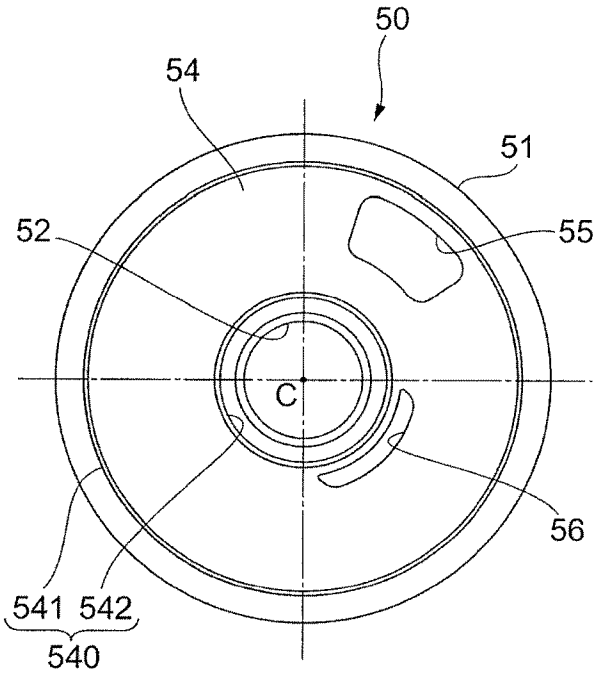
FIG. 8B is a view of the inner plate viewed from the other side in the direction of the rotation axis.
Figure 8A:
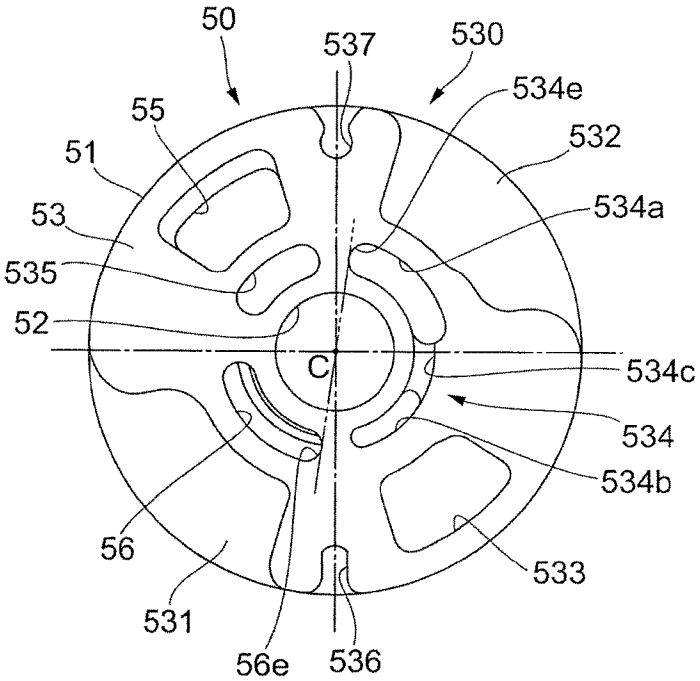
FIG. 8A is a view of an inner plate viewed from the one side in the direction of the rotation axis.

FIG. 8A is a view of the inner plate 50 viewed from the one side in the direction of the rotation axis. FIG. 8B is a view of the inner plate 50 viewed from the other side in the direction of the rotation axis.

The inner plate 50 is a substantially disc-shaped member that includes a through-hole at a central portion. The inner plate 50 includes an inner-plate outer circumferential surface 51; an inner-plate inner circumferential surface 52; an inner-plate cam ring side end surface 53, that is, an end surface that is positioned to face the cam ring 40 in the direction of the rotation axis; and an inner-plate non-cam ring side end surface 54, that is, an end surface that is positioned not to face the cam ring 40 in the direction of the rotation axis.

As illustrated in FIGS. 8A and 8B, when viewed in the direction of the rotation axis, the inner-plate outer circumferential surface 51 has a circular shape, and a distance from the rotation center C to the inner-plate outer circumferential surface 51 is substantially the same as that from the rotation center C to the outer circumferential cam ring surface 41 of the cam ring 40.

As illustrated in FIGS. 8A and 8B, when viewed in the direction of the rotation axis, the inner-plate inner circumferential surface 52 has a circular shape, and a distance from the rotation center C to the inner-plate inner circumferential surface 52 is substantially the same as that from the rotation center C to a groove bottom of the spline 21 formed on the inner circumferential surface of the rotor 20.

The inner plate 50 includes an inner-plate cam ring side recess portion 530 made up of multiple recess portions which are recessed from the inner-plate cam ring side end surface 53, and an inner-plate non-cam ring side recess portion 540 made up of multiple recess portions which are recessed from the inner-plate non-cam ring side end surface 54.

The inner-plate cam ring side recess portion 530 includes a high pressure side suction recess portion 531 that is formed to face the high pressure side suction recess portion 431 of the cam ring 40 and forms the high pressure side suction port 2. In addition, the inner-plate cam ring side recess portion 530 includes a low pressure side suction recess portion 532 that is formed to face the low pressure side suction recess portion 432 of the cam ring 40 and forms the low pressure side suction port 3. The high pressure side suction recess portion 531 and the low pressure side suction recess portion 532 are formed to be point-symmetrical with each other with respect to the rotation center C.

The inner-plate cam ring side recess portion 530 includes a low pressure side discharge recess portion 533 that is formed to face the low pressure side discharge recess portion 434 of the cam ring 40.

The inner-plate cam ring side recess portion 530 includes an inner-plate low pressure side recess portion 534 that is positioned to correspond to a circumferential range from the low pressure side suction recess portion 532 to the low pressure side discharge recess portion 533, and to face the columnar groove 232 of the vane groove 23 of the rotor 20 in the radial direction of rotation. The inner-plate low pressure side recess portion 534 includes a low pressure side upstream recess portion 534*a* that is positioned to correspond to the low pressure side suction recess portion 532 in the circumferential direction; a low pressure side downstream recess portion 534*b* that is positioned to correspond to the low pressure side discharge recess portion 533 in the circumferential direction; and a low pressure side connection recess portion 534*c* through which the low pressure side upstream recess portion 534*a* is connected to the low pressure side downstream recess portion 534*b*.

The inner-plate cam ring side recess portion 530 includes an inner-plate high pressure side recess portion 535 that is positioned to correspond to the high pressure side discharge recess portion 433 in the circumferential direction, and to face the columnar groove 232 of the vane groove 23 of the rotor 20 in the radial direction of rotation.

The inner-plate cam ring side recess portion 530 includes a first recess portion 536 that is formed to face the first through-hole 47 of the cam ring 40, and a second recess portion 537 that is formed to face the second through-hole 48.

The inner-plate non-cam ring side recess portion 540 includes an outer circumferential groove 541 which is formed in an outer circumferential portion of the inner-plate non-cam ring side end surface 54, and into which an outer circumferential O-ring 57 is fitted. In addition, the inner-plate non-cam ring side recess portion 540 includes an inner circumferential groove 542 which is formed in an inner circumferential portion of the inner-plate non-cam ring side end surface 54, and into which an inner circumferential O-ring 58 is fitted. The outer circumferential O-ring 57 and the inner circumferential O-ring 58 seal a gap between the inner plate 50 and the case 110.

A high pressure side discharge through-hole 55 is formed to pass through the inner plate 50 in the direction of the rotation axis, and is positioned to face the high pressure side discharge recess portion 443 of the cam ring 40. A cam ring 40 side opening of the high pressure side discharge through-hole 55 and an opening of the low pressure side discharge recess portion 533 are formed to be point-symmetrical with each other with respect to the rotation center C.

An inner-plate high pressure side through-hole 56 is formed to pass through the inner plate 50 in the direction of the rotation axis such that the inner-plate high pressure side through-hole 56 is positioned to correspond to the high pressure side suction recess portion 531 in the circumferential direction and to face the columnar groove 232 of the vane groove 23 of the rotor 20 in the radial direction of rotation.

<Configuration of Outer Plate 60>

Figure 9B:
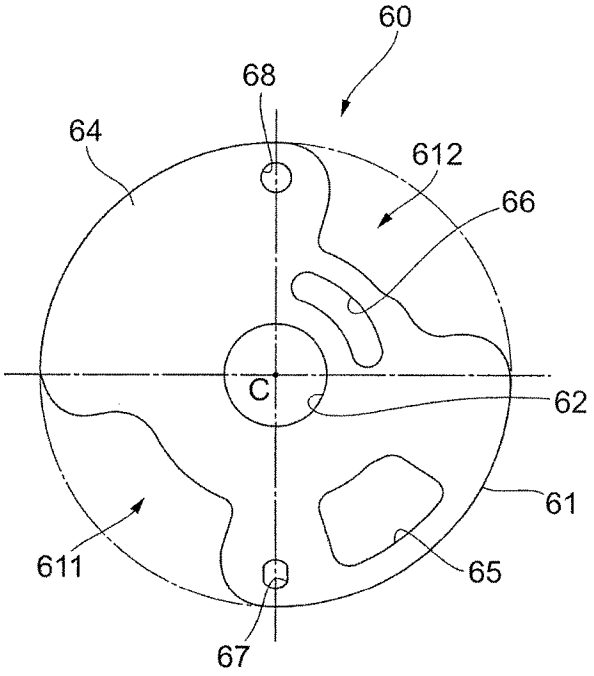
FIG. 9B is a view of the outer plate viewed from the one side in the direction of the rotation axis.
Figure 9A:
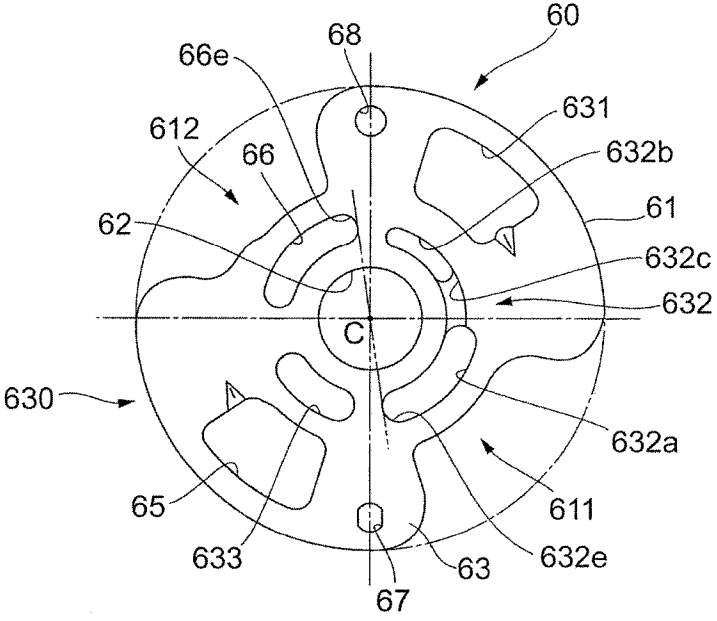
FIG. 9A is a view of an outer plate viewed from the other side in the direction of the rotation axis.

FIG. 9A is a view of the outer plate 60 viewed from the other side in the direction of the rotation axis. FIG. 9B is a view of the outer plate 60 viewed from the one side in the direction of the rotation axis.

The outer plate 60 is a substantially plate-like member that includes a through-hole at a central portion. The outer plate 60 includes an outer-plate outer circumferential surface 61; an outer-plate inner circumferential surface 62; an outer-plate cam ring side end surface 63, that is, an end surface that is positioned to face the cam ring 40 in the direction of the rotation axis; and an outer-plate non-cam ring side end surface 64, that is, an end surface that is positioned not to face the cam ring 40 in the direction of the rotation axis.

As illustrated in FIGS. 9A and 9B, when viewed in the direction of the rotation axis, the outer-plate outer circumferential surface 61 has a shape in which two portions are cut out from a circular base of the outer-plate outer circumferential surface 61. A distance from the rotation center C to the circular base is substantially the same as that from the rotation center C to the outer circumferential cam ring surface 41 of the cam ring 40. Two cut-outs include a high pressure side suction cut-out 611 that is formed to face the high pressure side suction recess portion 441 and forms the high pressure side suction port 2, and a low pressure side suction cut-out 612 that is formed to face the low pressure side suction recess portion 442 and forms the low pressure side suction port 3. The outer-plate outer circumferential surfaces 61 are formed to be point-symmetrical with each other with respect to the rotation center C. The high pressure side suction cut-out 611 and the low pressure side suction cut-out 612 are formed to be point-symmetrical with each other with respect to the rotation center C.

As illustrated in FIGS. 9A and 9B, when viewed in the direction of the rotation axis, the outer-plate inner circumferential surface 62 has a circular shape, and a distance from the rotation center C to the outer-plate inner circumferential surface 62 is substantially the same as that from the rotation center C to the groove bottom of the spline 21 formed on the inner circumferential surface of the rotor 20.

The outer plate 60 includes an outer-plate cam ring side recess portion 630 made up of multiple recess portions which are recessed from the outer-plate cam ring side end surface 63.

The outer-plate cam ring side recess portion 630 includes a high pressure side discharge recess portion 631 that is formed to face the high pressure side discharge recess portion 443 of the cam ring 40.

The outer-plate cam ring side recess portion 630 includes an outer-plate high pressure side recess portion 632 that is positioned to correspond to a circumferential range from the high pressure side suction cut-out 611 to the high pressure side discharge recess portion 631, and to face the columnar groove 232 of the vane groove 23 of the rotor 20 in the radial direction of rotation. The outer-plate high pressure side recess portion 632 includes a high pressure side upstream recess portion 632*a* that is positioned to correspond to the high pressure side suction cut-out 611 in the circumferential direction; a high pressure side downstream recess portion 632*b* that is positioned to correspond to the high pressure side discharge recess portion 631 in the circumferential direction; and a high pressure side connection recess portion 632*c* through which the high pressure side upstream recess portion 632*a* is connected to the high pressure side downstream recess portion 632*b*.

The outer-plate cam ring side recess portion 630 includes an outer-plate low pressure side recess portion 633 that is positioned to correspond to the low pressure side discharge recess portion 444 of the cam ring 40 in the circumferential direction, and to face the columnar groove 232 of the vane groove 23 of the rotor 20 in the radial direction of rotation.

A low pressure side discharge through-hole 65 is formed to pass through the outer plate 60 in the direction of the rotation axis, and is positioned to face the low pressure side discharge recess portion 444 of the cam ring 40. A cam ring 40 side opening of the low pressure side discharge through-hole 65 and an opening of the high pressure side discharge recess portion 631 are formed to be point-symmetrical with each other with respect to the rotation center C.

An outer-plate low pressure side through-hole 66 is formed to pass through the outer plate 60 in the direction of the rotation axis such that the outer-plate low pressure side through-hole 66 is positioned to correspond to the low pressure side suction cut-out 612 in the circumferential direction and to face the columnar groove 232 of the vane groove 23 of the rotor 20 in the radial direction of rotation.

A first through-hole 67 is formed to pass through the outer plate 60 in the direction of the rotation axis, and is positioned to face the first through-hole 47 of the cam ring 40. A second through-hole 68 is formed to pass through the outer plate 60 in the direction of the rotation axis, and is positioned to face the second through-hole 48 of the cam ring 40.

<Configuration of Housing 100>

The housing 100 accommodates the rotor 20; the vanes 30; the cam ring 40; the inner plate 50; and the outer plate 60. One end portion of the rotation shaft 10 is accommodated in the housing 100, and the other end portion of the rotation shaft 10 protrudes from the housing 100.

The case 110 and the cover 120 are tightened together with bolts.

<Configuration of Case 110>

Figure 10:
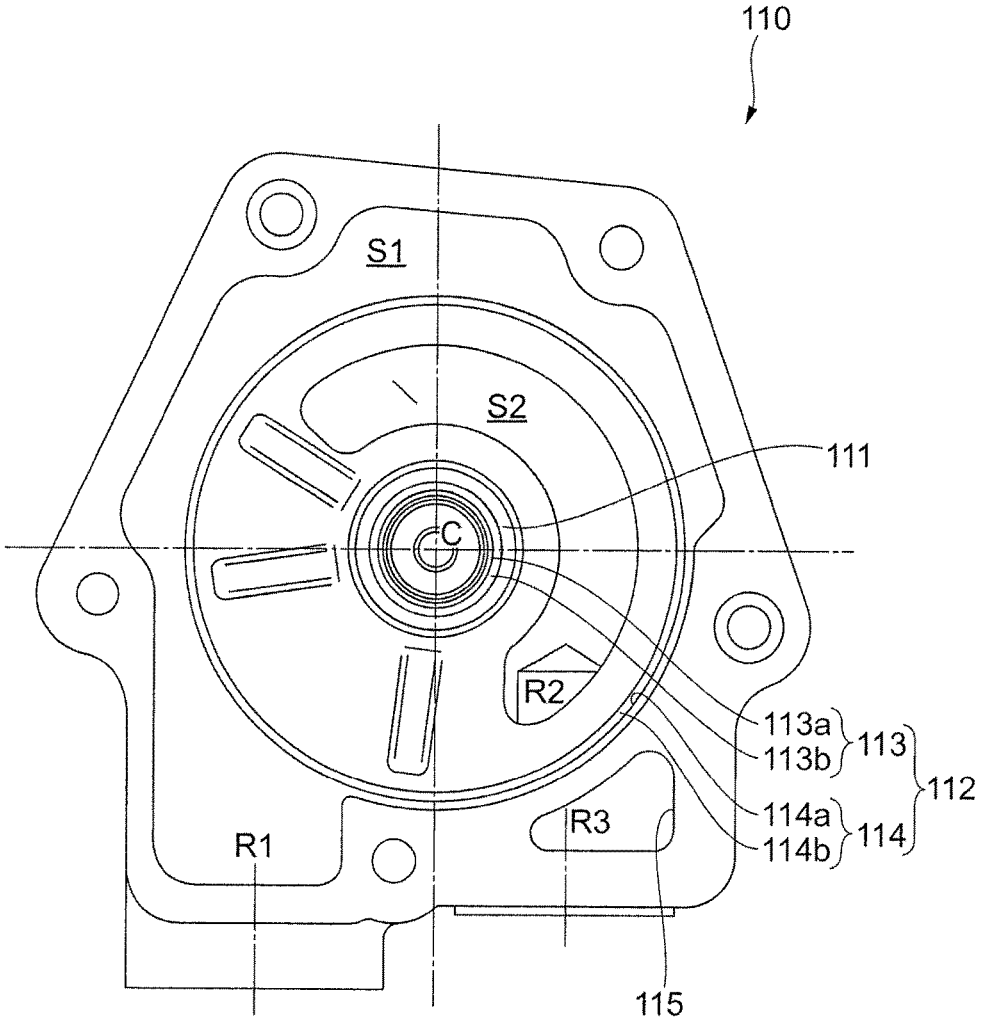
FIG. 10 is a view of a case viewed from the one side in the direction of the rotation axis.

FIG. 10 is a view of the case 110 viewed from the one side in the direction of the rotation axis.

The case 110 is a bottomed cylindrical member. The case bearing 111 is provided in a central portion of a bottom portion of the case 110, and rotatably supports the one end portion of the rotation shaft 10.

The case 110 includes an inner plate fitting portion 112 to which the inner plate 50 is fitted. The inner plate fitting portion 112 includes an inner-diameter side fitting portion 113 that is positioned close to the rotation center C (inner diameter side), and an outer-diameter side fitting portion 114 that is positioned apart from the rotation center C (outer diameter side).

As illustrated in FIG. 4, the inner-diameter side fitting portion 113 is provided on an outer diameter side of the case bearing 111. The inner-diameter side fitting portion 113 includes an inner-diameter side cover portion 113*a* that covers the vicinity of a portion of the inner-plate inner circumferential surface 52 of the inner plate 50, and an inner-diameter side preventive portion 113*b* that prevents movement of the inner plate 50 to the bottom portion. When viewed in the direction of the rotation axis, the inner-diameter side cover portion 113*a* has a circular shape in which a distance from the rotation center C to the inner-diameter side cover portion 113*a* is shorter than that from the rotation center C to the inner-plate inner circumferential surface 52. The inner-diameter side preventive portion 113*b* is a donut-shaped surface perpendicular to the direction of the rotation axis. A distance from the rotation center C to an inner circle of the inner-diameter side preventive portion 113*b* is the same as that from the rotation center C to the inner-diameter side cover portion 113*a*. A distance from the rotation center C to an outer circle of the inner-diameter side preventive portion 113*b* is shorter than that from the rotation center C to the inner-plate inner circumferential surface 52.

As illustrated in FIG. 4, the outer-diameter side fitting portion 114 includes an outer-diameter side cover portion 114*a* that covers the vicinity of a portion of the inner-plate outer circumferential surface 51 of the inner plate 50, and an outer-diameter side preventive portion 114*b* that prevents movement of the inner plate 50 to the bottom portion. When viewed in the direction of the rotation axis, the outer-diameter side cover portion 114*a* has a circular shape in which a distance from the rotation center C to the outer-diameter side cover portion 114*a* is longer than that from the rotation center C to the inner-plate outer circumferential surface 51. The outer-diameter side preventive portion 114*b* is a donut-shaped surface perpendicular to the direction of the rotation axis. A distance from the rotation center C to an outer circle of the outer-diameter side preventive portion 114*b* is the same as that from the rotation center C to the outer-diameter side cover portion 114*a*. A distance from the rotation center C to an inner circle of the outer-diameter side preventive portion 114*b* is shorter than that from the rotation center C to the inner-plate outer circumferential surface 51.

The inner plate 50 is inserted into the bottom portion until the inner circumferential O-ring 58, which is fitted into the inner circumferential groove 542 of the inner plate 50, comes into contact with the inner-diameter side preventive portion 113*b* and the outer circumferential O-ring 57, which is fitted into the outer circumferential groove 541, comes into contact with the outer-diameter side preventive portion 114*b*. The inner circumferential O-ring 58 is in contact with the inner circumferential groove 542 of the inner plate 50, the inner-diameter side cover portion 113*a*, and the inner-diameter side preventive portion 113*b* of the case 110. The outer circumferential O-ring 57 is in contact with the outer circumferential groove 541 of the inner plate 50, and the outer-diameter side cover portion 114*a* and the outer-diameter side preventive portion 114*b* of the case 110. Accordingly, a gap between the case 110 and the inner plate 50 is sealed. As a result, an inner space of the case 110 is divided into a space S1 further on the opening side of the inner plate fitting portion 112, and a bottom portion side space S2 positioned below the inner plate fitting portion 112. The opening side space S1, which is positioned above the inner plate fitting portion 112, forms a suction passage R1 of oil that is suctioned from the high pressure side suction port 2 and the low pressure side suction port 3. The bottom portion side space S2, which is positioned below the inner plate fitting portion 112, forms a high pressure side discharge passage R2 of oil that is discharged from the high pressure side discharge port 4.

Separately from an accommodating space in which the rotor 20, the vanes 30, the cam ring 40, the inner plate 50, and the outer plate 60 are accommodated, the case 110 includes a case outer recess portion 115 that is positioned outside of the accommodating space in the radial direction of rotation, and that is recessed from an opening side in the direction of the rotation axis. The case outer recess portion 115 faces a cover outer recess portion 123 (to be described later) formed in the cover 120, and forms a case low pressure side discharge passage R3 of oil that is discharged from the low pressure side discharge port 5.

As illustrated in FIGS. 1 and 2, the case 110 includes the suction inlet 116 that communicates with the opening side space S1 positioned above the inner plate fitting portion 112, and with the outside of the case 110. The suction inlet 116 is configured to include a columnar hole formed in a side wall of the case 110, of which a columnar direction is perpendicular to the direction of the rotation axis. The suction inlet 116 forms the suction passage R1 of oil that is suctioned from the high pressure side suction port 2 and the low pressure side suction port 3.

As illustrated in FIGS. 1 and 2, the case 110 includes the high pressure side discharge outlet 117 that communicates with the bottom portion side space S2 positioned below the inner plate fitting portion 112, and with the outside of the case 110. The high pressure side discharge outlet 117 is configured to include a columnar hole formed in the side wall of the case 110, of which a columnar direction is perpendicular to the direction of the rotation axis. The high pressure side discharge outlet 117 forms the high pressure side discharge passage R2 of oil that is discharged from the high pressure side discharge port 4.

As illustrated in FIGS. 1 and 2, the case 110 includes the low pressure side discharge outlet 118 that communicates with the case outer recess portion 115 and the outside of the case 110. The low pressure side discharge outlet 118 is configured to include a columnar hole formed in a side wall of the case outer recess portion 115 of the case 110, of which a columnar direction is perpendicular to the direction of the rotation axis. The low pressure side discharge outlet 118 forms the case low pressure side discharge passage R3 of oil that is discharged from the low pressure side discharge port 5.

The suction inlet 116, the high pressure side discharge outlet 117, and the low pressure side discharge outlet 118 are formed to face the same direction. That is, when viewed from a direction perpendicular to the direction of the rotation axis of the rotation shaft 10, the suction inlet 116, the high pressure side discharge outlet 117, and the low pressure side discharge outlet 118 are formed such that openings thereof are illustrated on the same drawing sheet as illustrated in FIG. 1. In other words, the suction inlet 116, the high pressure side discharge outlet 117, and the low pressure side discharge outlet 118 are formed on the same side surface 110*a* of the case 110. The directions (columnar directions) of the respective columnar holes of the suction inlet 116, the high pressure side discharge outlet 117, and the low pressure side discharge outlet 118 are the same.

(Configuration of Cover 120)

Figure 11:
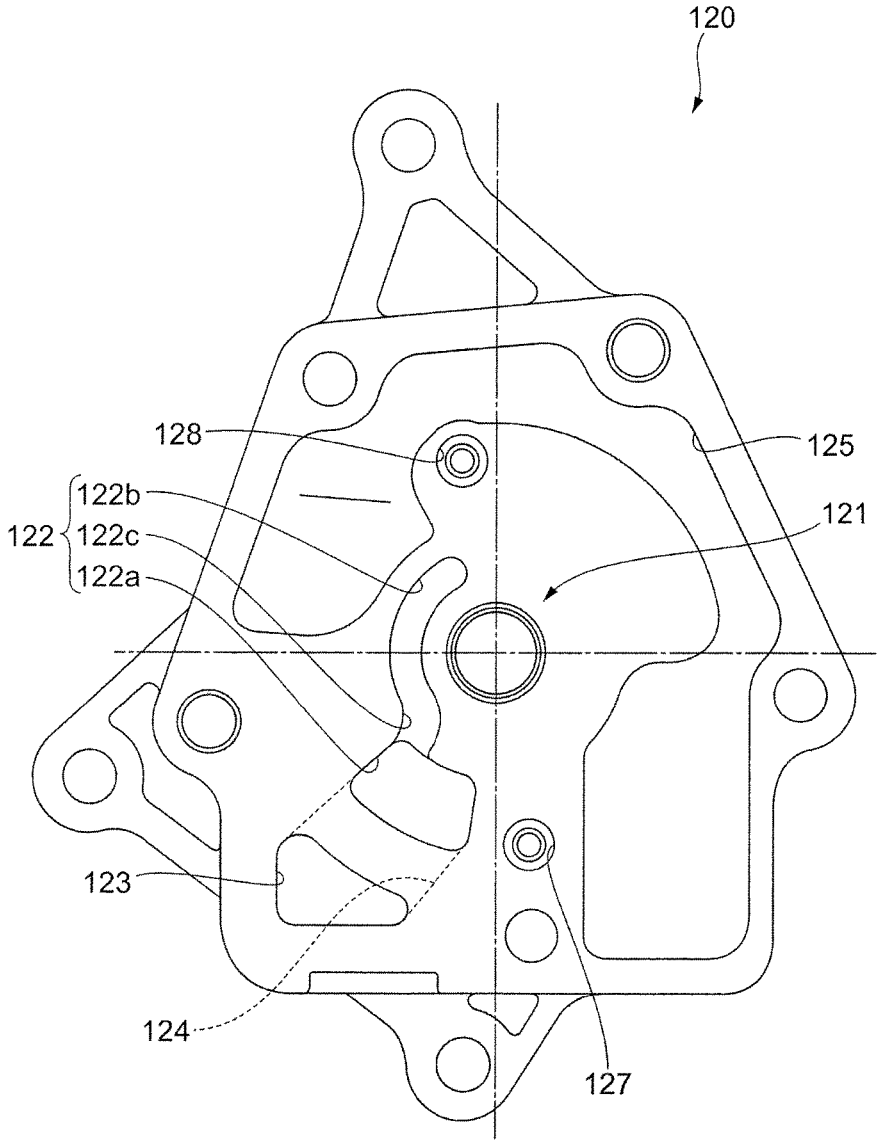
FIG. 11 is a view of a cover viewed from the other side in the direction of the rotation axis.

FIG. 11 is a view of the cover 120 viewed from the other side in the direction of the rotation axis.

The cover 120 includes the cover bearing 121 at a central portion, which rotatably supports the rotation shaft 10.

The cover 120 includes a cover low pressure side discharge-recess portion 122 that is positioned to face the low pressure side discharge through-hole 65 of the outer plate 60, and the outer-plate low pressure side through-hole 66, and that is recessed from a case 110 side end surface of the cover 120 in the direction of the rotation axis. The cover low pressure side discharge-recess portion 122 includes a first cover low pressure side discharge-recess portion 122*a* that is formed to face the low pressure side discharge through-hole 65; a second cover low pressure side discharge-recess portion 122*b* that is formed to face the outer-plate low pressure side through-hole 66; and a third cover low pressure side discharge-recess portion 122*c* through which the first cover low pressure side discharge-recess portion 122*a* is connected to the second cover low pressure side discharge-recess portion 122*b*.

The cover 120 includes the cover outer recess portion 123 that is positioned outside of the cover low pressure side discharge-recess portion 122 in the radial direction of rotation, and that is recessed from the case 110 side end surface in the direction of the rotation axis. In addition, the cover 120 includes a cover recess portion connection portion 124 through which the cover outer recess portion 123 is connected to the first cover low pressure side discharge-recess portion 122*a* of the cover low pressure side discharge-recess portion 122 further on the other side in the direction of the rotation axis than the case 110 side end surface. The cover outer recess portion 123 is formed such that an opening of the cover outer recess portion 123 is positioned not to face the aforementioned accommodating space formed in the case 110, but to face the case outer recess portion 115. The cover low pressure side discharge-recess portion 122, the cover recess portion connection portion 124, and the cover outer recess portion 123 form a cover low pressure side discharge passage R4 (refer to FIG. 5) of oil that is discharged from the low pressure side discharge port 5. The oil discharged from the low pressure side discharge port 5 flows into the case low pressure side discharge passage R3 via the cover recess portion connection portion 124, and flows into the outer-plate low pressure side through-hole 66 via the second cover low pressure side discharge-recess portion 122*b* and the third cover low pressure side discharge-recess portion 122*c*.

The second cover low pressure side discharge-recess portion 122*b* and the third cover low pressure side discharge-recess portion 122*c* are formed to have a depth and a width smaller than those of the first cover low pressure side discharge-recess portion 122*a*. The amount of the oil flowing into the outer-plate low pressure side through-hole 66 is smaller than the amount of the oil flowing into the case low pressure side discharge passage R3.

A cover suction-recess portion 125 is formed at a portion of the cover 120 which faces the high pressure side suction cut-out 611 and the low pressure side suction cut-out 612 of the outer plate 60, and at a portion of the cover 120 which faces the space S1 further on the opening side of the inner plate fitting portion 112 of the case 110, and a space outside of the outer circumferential cam ring surface 41 of the cam ring 40 in the radial direction of rotation. The cover suction-recess portion 125 is recessed from the case 110 side end surface in the direction of the rotation axis.

The cover suction-recess portion 125 forms the suction passage R1 of oil that is suctioned from the suction inlet 116, and then is suctioned into the pump chamber from the high pressure side suction port 2 and the low pressure side suction port 3.

The cover 120 includes a first cover recess portion 127 and a second cover recess portion 128 which are respectively positioned to face the first through-hole 67 and the second through-hole 68 of the outer plate 60, and which are recessed from the case 110 side end surface in the direction of the rotation axis.

<Method of Assembling Vane Pump 1>

The vane pump 1 in the embodiment is assembled in the following manner.

The inner plate 50 is fitted into the inner plate fitting portion 112 of the case 110. The case 110 and the cover 120 are connected to each other with multiple (five in the embodiment) bolts such that the inner-plate cam ring side end surface 53 of the inner plate 50 comes into contact with the inner end surface 43 of the cam ring 40, and the outer end surface 44 of the cam ring 40 comes into contact with the outer-plate cam ring side end surface 63 of the outer plate 60.

The first recess portion 536 of the inner plate 50 holds one end portion of a cylindrical or columnar positioning pin passing through the first through-hole 47 formed in the cam ring 40 and the first through-hole 67 formed in the outer plate 60. The first cover recess portion 127 of the cover 120 holds the other end portion of the positioning pin. In addition, the second recess portion 537 of the inner plate 50 holds one end portion of a cylindrical or columnar positioning pin passing through the second through-hole 48 formed in the cam ring 40 and the second through-hole 68 formed in the outer plate 60. The second cover recess portion 128 of the cover 120 holds the other end portion of the positioning pin. Accordingly, a relative position among the inner plate 50, the cam ring 40, the outer plate 60, and the cover 120 is determined.

The rotor 20 and the vanes 30 are accommodated inside the cam ring 40. The one end portion of the rotation shaft 10 is rotatably supported by the case bearing 111 of the case 110. A portion of the rotation shaft 10 between the one end portion and the other end portion is rotatably supported by the cover bearing 121 of the cover 120 with the other end portion exposed from the housing 100.

<Operation of Vane Pump 1>

The vane pump 1 in the embodiment includes ten vanes 30 and ten pump chambers, each of which is formed by two adjacent vanes 30, an outer circumferential surface of the rotor 20 between the two adjacent vanes 30, the inner circumferential cam ring surface 42 between the two adjacent vanes 30, the inner-plate cam ring side end surface 53 of the inner plate 50, and the outer-plate cam ring side end surface 63 of the outer plate 60 when the ten vanes 30 come into contact with the inner circumferential cam ring surface 42 of the cam ring 40. In a case where attention is paid to only one pump chamber, when the rotation shaft 10 rotates one revolution, and the rotor 20 rotates one revolution, the pump chamber rotates one revolution around the rotation shaft 10. During one revolution of the pump chamber, oil suctioned from the high pressure side suction port 2 is compressed such that the pressure of the oil is increased, and then the oil is discharged from the high pressure side discharge port 4. Oil suctioned from the low pressure side suction port 3 is compressed such that the pressure of the oil is increased, and then the oil is discharged from the low pressure side discharge port 5. As illustrated in FIG. 7, the shape of the inner circumferential cam ring surface 42 of the cam ring 40 is formed such that the distance from the rotation center C to the first protrusion 42*a* of the inner circumferential cam ring surface 42 at each rotational angular position is longer than that from the rotation center C to the second protrusion 42*b*. As a result, the vane pump 1 in the embodiment discharges an amount of low pressure oil from the low pressure side discharge port 5, which is larger than the amount of oil discharged from the high pressure side discharge port 4. Since the base of the second protrusion 42*b* is smoother than that of the first protrusion 42*a*, the discharge pressure of oil discharged from the high pressure side discharge port 4 is higher than that of oil discharged from the low pressure side discharge port 5.

Figure 12:
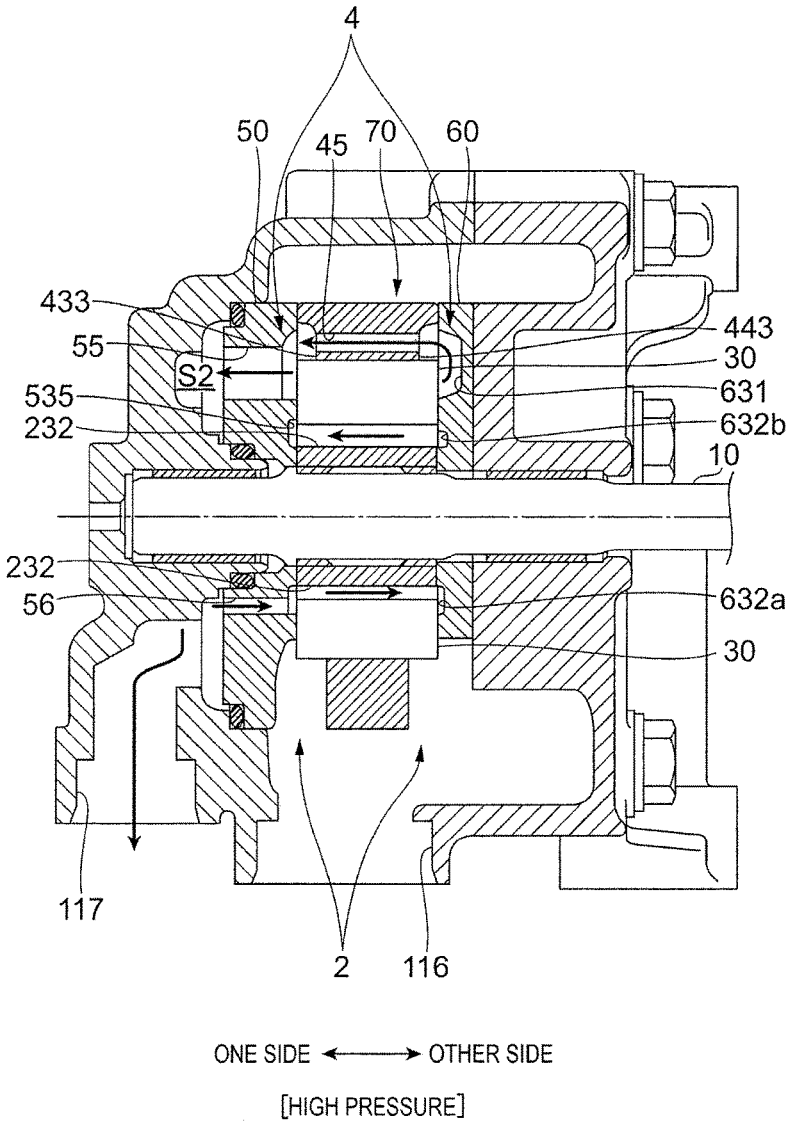
FIG. 12 is a view illustrating the flow of high pressure oil.

FIG. 12 is a view illustrating the flow of high pressure oil.

Oil (hereinafter, referred to as "high pressure oil"), which is discharged from the high pressure side discharge port 4, flows into the space S2 (further on the bottom portion side of the inner plate fitting portion 112) via the high pressure side discharge through-hole 55 of the inner plate 50, and then is discharged from the high pressure side discharge outlet 117. A portion of the high pressure oil, which has flowed into the space S2 (further on the bottom portion side of the inner plate fitting portion 112) via the high pressure side discharge through-hole 55 of the inner plate 50, flows into the columnar grooves 232 of the vane grooves 23 of the rotor 20, which face the space S2, via the inner-plate high pressure side through-hole 56. A portion of the high pressure oil, which has flowed into the columnar grooves 232 of the vane grooves 23, flows into the high pressure side upstream recess portion 632*a* of the outer plate 60. A portion of the high pressure oil, which has flowed into the high pressure side upstream recess portion 632*a* of the outer plate 60, flows into the high pressure side downstream recess portion 632*b* via the high pressure side connection recess portion 632*c* (refer to FIG. 9A). A portion of the high pressure oil, which has flowed into the high pressure side downstream recess portion 632*b* of the outer plate 60, flows into the columnar grooves 232 of the vane grooves 23 of the rotor 20 which face the high pressure side downstream recess portion 632*b*, and then flows into the inner-plate high pressure side recess portion 535 of the inner plate 50. Since the high pressure side upstream recess portion 632*a*, the high pressure side connection recess portion 632*c*, and the high pressure side downstream recess portion 632*b* are provided to correspond to a range from the high pressure side suction port 2 to the high pressure side discharge port 4, high pressure oil flows into the columnar grooves 232 of the vane grooves 23 corresponding to a high pressure side pump chamber. As a result, since the high pressure oil flows into the columnar grooves 232 of the vane grooves 23, even if force toward the rotation center is applied to the vanes 30 by increased pressure oil in the high pressure side pump chamber, the tips of the vanes 30 easily come into contact with the inner circumferential cam ring surface 42.

Figure 13:
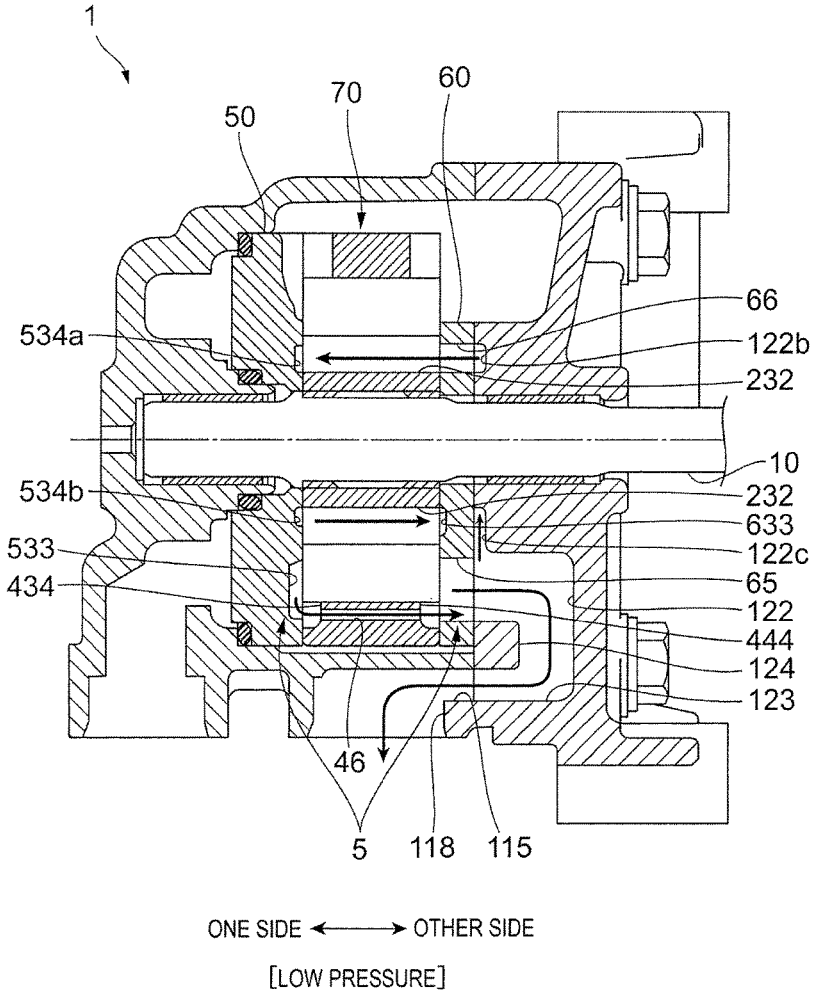
FIG. 13 is a view illustrating the flow of low pressure oil.

FIG. 13 is a view illustrating the flow of low pressure oil.

In contrast, oil (hereinafter, referred to as "low pressure oil"), which is discharged from the low pressure side discharge port 5, flows into the cover low pressure side discharge-recess portion 122 via the low pressure side discharge through-hole 65 of the outer plate 60, and then is discharged from the low pressure side discharge outlet 118. A portion of the low pressure oil, which has flowed into the third cover low pressure side discharge-recess portion 122*c* of the cover low pressure side discharge-recess portion 122 via the low pressure side discharge through-hole 65 of the outer plate 60, flows into the columnar grooves 232 of the vane grooves 23 of the rotor 20, which face the third cover low pressure side discharge-recess portion 122*c*, via the second cover low pressure side discharge-recess portion 122*b* and the outer-plate low pressure side through-hole 66. A portion of the low pressure oil, which has flowed into the columnar grooves 232 of the vane grooves 23, flows into the low pressure side upstream recess portion 534*a* of the inner plate 50. A portion of the low pressure oil, which has flowed into the low pressure side upstream recess portion 534*a* of the inner plate 50, flows into the low pressure side downstream recess portion 534*b* via the low pressure side connection recess portion 534*c* (refer to FIG. 8A). A portion of the low pressure oil, which has flowed into the low pressure side downstream recess portion 534*b* of the inner plate 50, flows into the columnar grooves 232 of the vane grooves 23 of the rotor 20 which face the low pressure side downstream recess portion 534*b*, and then flows into the outer-plate low pressure side recess portion 633 of the outer plate 60. Since the low pressure side upstream recess portion 534*a*, the low pressure side connection recess portion 534*c*, and the low pressure side downstream recess portion 534*b* are provided to correspond to a range from the low pressure side suction port 3 to the low pressure side discharge port 5, low pressure oil flows into the columnar grooves 232 of the vane grooves 23 corresponding to a low pressure side pump chamber. As a result, since the low pressure oil flows into the columnar grooves 232 of the vane grooves 23 corresponding to the vanes 30 of the low pressure side pump chamber, contact pressure between the tips of the vanes 30 and the inner circumferential cam ring surface 42 is low compared to a case in which high pressure oil flows into the columnar grooves 232.

<Regarding Oil Passage Formed in Inner Plate 50, and Facing Vane Groove 23 of Rotor 20>

Hereinafter, a relationship between the inner-plate high pressure side recess portion 535 (that is, a high pressure oil passage) and the inner-plate low pressure side recess portion 534 (that is, a low pressure oil passage), which are formed in the inner plate 50, will be described. In addition, a relationship between the inner-plate high pressure side through-hole 56 (that is, a high pressure oil passage) and the inner-plate low pressure side recess portion 534 (that is, a low pressure oil passage), which are formed in the inner plate 50, will be described.

Figure 14B:
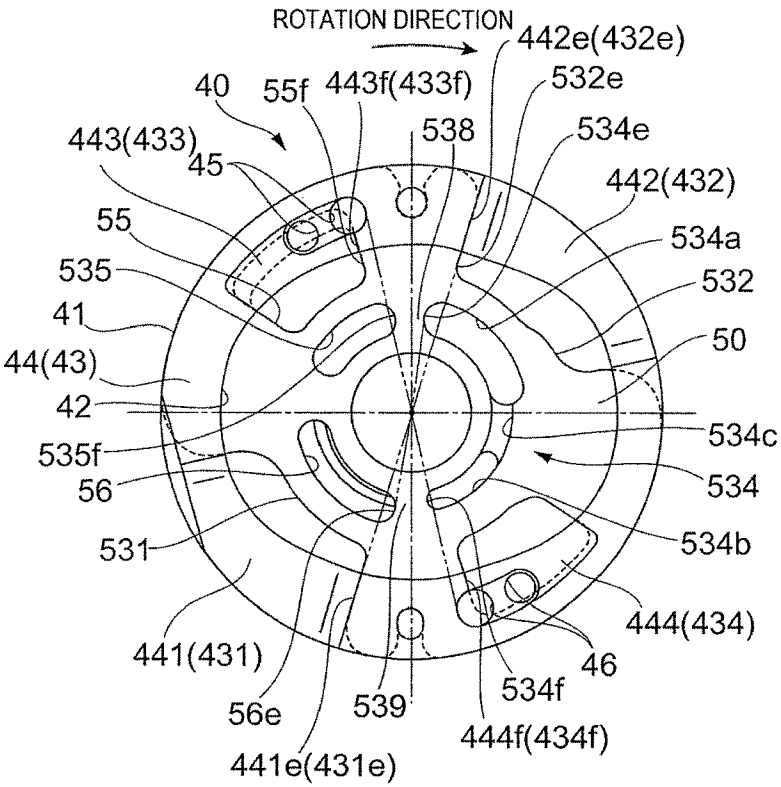
FIGS. 14A and 14B are views illustrating a relationship between an inner-plate high pressure side recess portion and an inner-plate low pressure side recess portion, and a relationship between an inner-plate high pressure side through-hole and the inner-plate low pressure side recess portion.
Figure 14A:
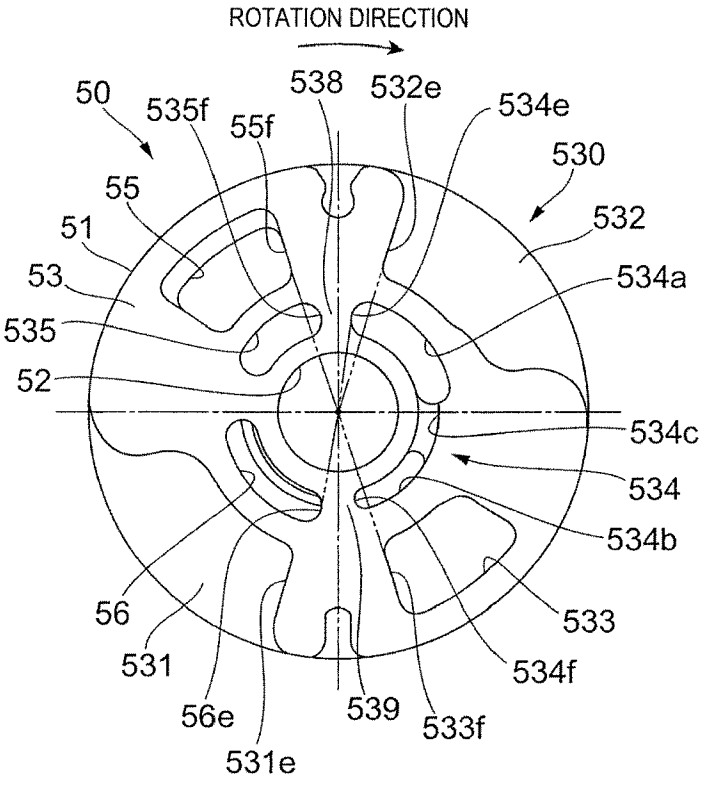

FIGS. 14A and 14B are views illustrating the relationship between the inner-plate high pressure side recess portion 535 and the inner-plate low pressure side recess portion 534, and the relationship between the inner-plate high pressure side through-hole 56 and the inner-plate low pressure side recess portion 534. FIG. 14A is a view of the inner plate 50 viewed from the one side in the direction of the rotation axis. FIG. 14B is a view of the cam ring 40 and the inner plate 50 viewed from the one side in the direction of the rotation axis.

(Regarding Relationship Between Inner-Plate High Pressure Side Recess Portion 535 and Inner-Plate Low Pressure Side Recess Portion 534)

High pressure oil is supplied from the inner-plate high pressure side recess portion 535 to the columnar grooves 232 of the vane grooves 23 which support the vanes 30 forming a high pressure side pump chamber discharging high pressure oil. In contrast, low pressure oil is supplied from the inner-plate low pressure side recess portion 534 to the columnar grooves 232 of the vane grooves 23 which support the vanes 30 forming a low pressure side pump chamber discharging low pressure oil. In the vane pump 1 of the embodiment, this oil supply is realized by configurations described below in (1) and (2). (1) The inner-plate high pressure side recess portion 535 and the inner-plate low pressure side recess portion 534 are separated from each other between the high pressure side discharge port 4 and the low pressure side suction port 3 in the rotation direction (circumferential direction). (2) The size of a separation portion between the inner-plate high pressure side recess portion 535 and the inner-plate low pressure side recess portion 534 in the rotation direction (circumferential direction) is set such that the inner-plate high pressure side recess portion 535 does not communicate with the inner-plate low pressure side recess portion 534 via the vane groove 23 positioned between the inner-plate high pressure side recess portion 535 and the inner-plate low pressure side recess portion 534.

That is, as illustrated in FIG. 14A, in the configuration described in (1), an inner-plate high pressure side recess portion downstream end 535*f*, which is a downstream end portion (hereinafter, referred to as a "downstream end") of the inner-plate high pressure side recess portion 535 in the rotation direction, is not continuous with an inner-plate low pressure side recess portion upstream end 534*e* which is an upstream end portion (hereinafter, referred to as an "upstream end") of the inner-plate low pressure side recess portion 534 in the rotation direction. An inner-plate low pressure side suction upstream separator 538 is positioned between the inner-plate high pressure side recess portion downstream end 535*f* and the inner-plate low pressure side recess portion upstream end 534*e* in the rotation direction. The inner-plate low pressure side suction upstream separator 538 between the inner-plate high pressure side recess portion 535 and the inner-plate low pressure side recess portion 534 is positioned in the rotation direction between a high pressure side discharge through-hole downstream end 55*f*, which is a downstream end of the high pressure side discharge through-hole 55 of the inner plate 50 which forms the high pressure side discharge port 4, and a low pressure side suction-recess portion upstream end 532*e* which is an upstream end of the low pressure side suction recess portion (a portion facing a pump chamber) 532 which forms the low pressure side suction port 3. As illustrated in FIG. 14B, the inner-plate low pressure side suction upstream separator 538 between the inner-plate high pressure side recess portion 535 and the inner-plate low pressure side recess portion 534 is positioned in the rotation direction between a high pressure side discharge-recess portion downstream end 433*f* (443*f*), which is a downstream end of the high pressure side discharge recess portion 433 (443) of the cam ring 40 which forms the high pressure side discharge port 4, and a low pressure side suction-recess portion upstream end 432*e* (442*e*) which is an upstream end of the low pressure side suction recess portion 432 (442) forming the low pressure side suction port 3.

Figure 15:
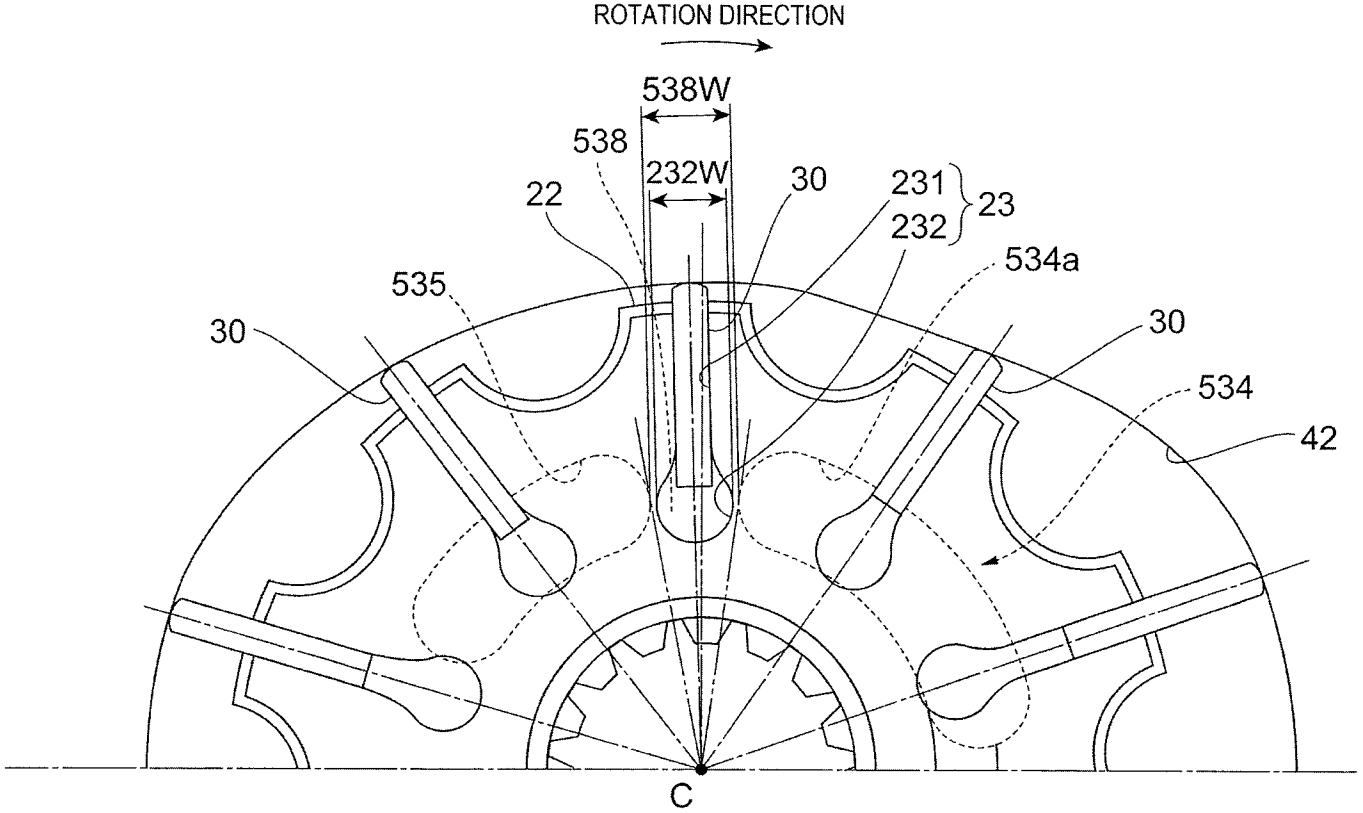
FIG. 15 is a view illustrating the size of an inner-plate low pressure side suction upstream separator in a rotation direction.

FIG. 15 is a view illustrating the size of the inner-plate low pressure side suction upstream separator 538 in the rotation direction.

In the configuration described in (2), for example, as illustrated in FIG. 15, a size 538W of the inner-plate low pressure side suction upstream separator 538 in the rotation direction is larger than a size 232W of the columnar groove 232 of the vane groove 23 in the rotation direction. In other words, for example, the size 538W of the inner-plate low pressure side suction upstream separator 538 in the rotation direction is set such that the inner-plate high pressure side recess portion 535 and the inner-plate low pressure side recess portion 534 do not extend to the columnar groove 232 of the vane groove 23. For example, in a case where the size 538W of the inner-plate low pressure side suction upstream separator 538 in the rotation direction is smaller than the size 232W of the columnar groove 232 of the vane groove 23 in the rotation direction, and the size 538W is set such that the inner-plate high pressure side recess portion 535 and the inner-plate low pressure side recess portion 534 extend to the columnar groove 232 of the vane groove 23, the inner-plate high pressure side recess portion 535 communicates with the inner-plate low pressure side recess portion 534 via the vane groove 23. In a case where the inner-plate high pressure side recess portion 535 communicates with the inner-plate low pressure side recess portion 534 via the vane groove 23, high pressure oil in the inner-plate high pressure side recess portion 535 flows into the inner-plate low pressure side recess portion 534 via the vane groove 23, and high pressure oil flows into the columnar groove 232 of the vane groove 23 which supports the vane 30 forming a low pressure side pump chamber. In a case where high pressure oil flows into the columnar groove 232 of the vane groove 23 which supports the vane 30 forming a low pressure side pump chamber, the pressure of oil in the vane groove 23, in which a rear end (end portion close to the rotation center) of the vane 30 is positioned, becomes higher than that of the oil of the low pressure side pump chamber in which the tip of the vane 30 is positioned. Accordingly, contact pressure between the tip of the vane 30 of the low pressure side pump chamber and the inner circumferential cam ring surface 42 is increased compared to a case in which low pressure oil flows into the columnar groove 232. As a result, torque loss may occur, or oil may leak from the columnar groove 232 to the low pressure side pump chamber on a tip side of the vane 30. In the configuration of the embodiment, since the inner-plate high pressure side recess portion 535 does not communicate with the inner-plate low pressure side recess portion 534 via the vane groove 23, the occurrence of torque loss or oil leakage is prevented. In addition, due to high pressure oil in the inner-plate high pressure side recess portion 535 flowing into the inner-plate low pressure side recess portion 534 via the vane groove 23, the pressure of oil in the columnar groove 232 of the vane groove 23, in which the rear end (end portion close to the rotation center) of the vane 30 is positioned, becomes lower than that of oil in the high pressure side pump chamber in which the tip of the vane 30 is positioned, which is a problem. In a case where the pressure of oil in the columnar groove 232 of the vane groove 23, in which the rear end of the vane 30 is positioned, becomes lower than that of oil in the pump chamber in which the tip of the vane 30 is positioned, oil may leak from the pump chamber to the columnar groove 232. In the configuration of the embodiment, since the inner-plate high pressure side recess portion 535 does not communicate with the inner-plate low pressure side recess portion 534 via the vane groove 23, leaking of oil from the high pressure side pump chamber into the columnar groove 232 is prevented.

(Regarding Relationship Between Inner-Plate High Pressure Side Through-Hole 56 and Inner-Plate Low Pressure Side Recess Portion 534)

High pressure oil is supplied from the inner-plate high pressure side through-hole 56 to the columnar grooves 232 of the vane grooves 23 which support the vanes 30 forming a high pressure side pump chamber discharging high pressure oil. In contrast, low pressure oil is supplied from the inner-plate low pressure side recess portion 534 to the columnar grooves 232 of the vane grooves 23 which support the vanes 30 forming a low pressure side pump chamber discharging low pressure oil. In the vane pump 1 of the embodiment, this oil supply is realized by configurations described below in (3) and (4). (3) The inner-plate high pressure side through-hole 56 and the inner-plate low pressure side recess portion 534 are separated from each other between the low pressure side discharge port 5 and the high pressure side suction port 2 in the rotation direction. (4) The size of a separation portion between the inner-plate high pressure side through-hole 56 and the inner-plate low pressure side recess portion 534 in the rotation direction is set such that the inner-plate high pressure side through-hole 56 does not communicate with the inner-plate low pressure side recess portion 534 via the vane grooves 23 positioned between the inner-plate high pressure side through-hole 56 and the inner-plate low pressure side recess portion 534.

That is, as illustrated in FIG. 14A, in the configuration described in (3), an inner-plate low pressure side recess portion downstream end 534*f*, which is a downstream end of the inner-plate low pressure side recess portion 534, is not continuous with an inner-plate high pressure side through-hole upstream end 56*e* which is an upstream end of the inner-plate high pressure side through-hole 56. An inner-plate high pressure side suction upstream separator 539 is positioned between inner-plate low pressure side recess portion downstream end 534*f* and the inner-plate high pressure side through-hole upstream end 56*e* in the rotation direction. The inner-plate high pressure side suction upstream separator 539 between the inner-plate low pressure side recess portion 534 and the inner-plate high pressure side through-hole 56 is positioned in the rotation direction between a low pressure side discharge-recess portion downstream end 533*f*, which is a downstream end of the low pressure side discharge recess portion 533 of the inner plate 50 which forms the low pressure side discharge port 5, and a high pressure side suction-recess portion upstream end 531*e* which is an upstream end of the high pressure side suction recess portion 531 (a portion facing a pump chamber) which forms the high pressure side suction port 2. As illustrated in FIG. 14B, the inner-plate high pressure side suction upstream separator 539 between the inner-plate low pressure side recess portion 534 and the inner-plate high pressure side through-hole 56 is positioned in the rotation direction between a low pressure side discharge-recess portion downstream end 434*f* (444*f*), which is a downstream end of the low pressure side discharge recess portion 434 (444) of the cam ring 40 which forms the low pressure side discharge port 5, and a high pressure side suction-recess portion upstream end 431*e* (441*e*) which is an upstream end of the high pressure side suction recess portion 431 (441) forming the high pressure side suction port 2.

In the configuration described in (4), for example, the size of the inner-plate high pressure side suction upstream separator 539 in the rotation direction is larger than the size 232W of the columnar groove 232 of the vane groove 23 in the rotation direction. In other words, the size of the inner-plate high pressure side suction upstream separator 539 in the rotation direction is set such that the inner-plate low pressure side recess portion 534 and the inner-plate high pressure side through-hole 56 do not extend to the columnar groove 232 of the vane groove 23. In this configuration, it is possible to prevent flowing of high pressure oil into the inner-plate low pressure side recess portion 534 via the vane groove 23, and flowing of high pressure oil into the columnar grooves 232 of the vane grooves 23 which support the vanes 30 forming the low pressure side pump chamber, which is caused by communication between the inner-plate low pressure side recess portion 534 and the inner-plate high pressure side through-hole 56 via the vane groove 23. Accordingly, contact pressure between the tip of the vane 30 of the low pressure side pump chamber and the inner circumferential cam ring surface 42 is decreased compared to a case in which high pressure oil flows into the columnar groove 232. As a result, the occurrence of torque loss is prevented. Leaking of oil from the columnar groove 232 into the low pressure side pump chamber on a tip side of the vane 30 is prevented. In addition, it is possible to prevent leaking of oil from the high pressure side pump chamber into the columnar groove 232 via the vane groove 23, which is caused by flowing of high pressure oil in the inner-plate high pressure side through-hole 56 into the inner-plate low pressure side recess portion 534 via the vane groove 23.

<Regarding Oil Passage Formed in Outer Plate 60, and Facing Vane Groove 23 of Rotor 20>

Hereinafter, a relationship between the outer-plate high pressure side recess portion 632 (that is, a high pressure oil passage) and the outer-plate low pressure side through-hole 66 (that is, a low pressure oil passage), which are formed in the outer plate 60, will be described. In addition, a relationship between the outer-plate high pressure side recess portion 632 (that is, a high pressure oil passage) and the outer-plate low pressure side recess portion 633 (that is, a low pressure oil passage), which are formed in the outer plate 60, will be described.

Figure 16B:
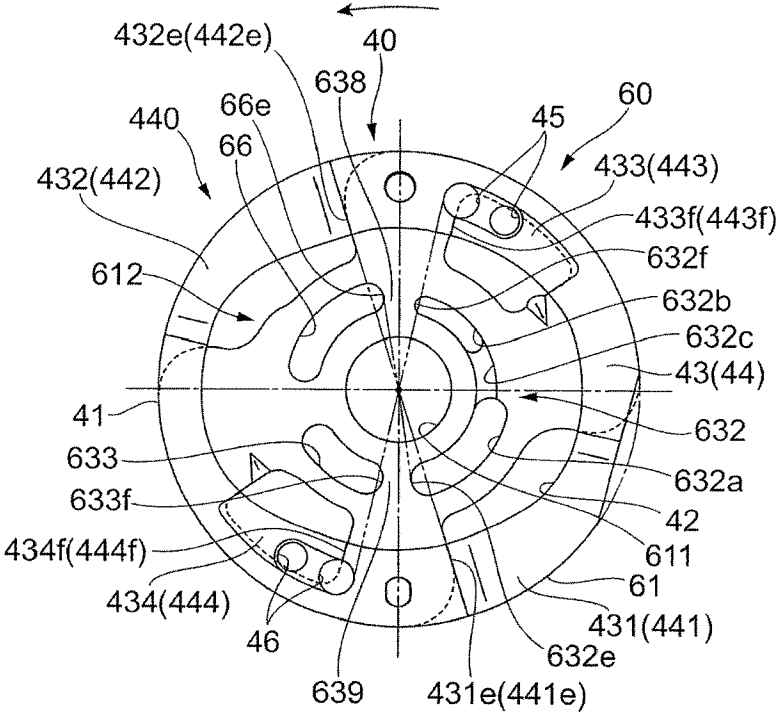
FIGS. 16A and 16B are views illustrating a relationship between an outer-plate high pressure side recess portion and an outer-plate low pressure side through-hole, and a relationship between an outer-plate low pressure side recess portion and the outer-plate high pressure side recess portion.
Figure 16A:
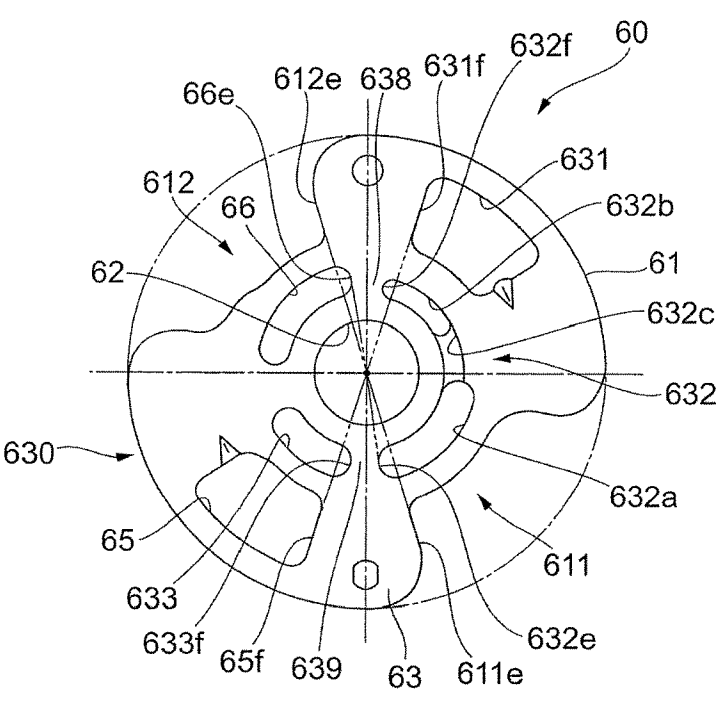

FIGS. 16A and 16B are views illustrating the relationship between the outer-plate high pressure side recess portion 632 and the outer-plate low pressure side through-hole 66, and the relationship between the outer-plate low pressure side recess portion 633 and the outer-plate high pressure side recess portion 632. FIG. 16A is a view of the outer plate 60 viewed from the other side in the direction of the rotation axis. FIG. 16B is a view of the cam ring 40 and the outer plate 60 viewed from the other side in the direction of the rotation axis.

(Regarding Relationship Between Outer-Plate High Pressure Side Recess Portion 632 and Outer-Plate Low Pressure Side Through-Hole 66)

High pressure oil is supplied from the outer-plate high pressure side recess portion 632 to the columnar grooves 232 of the vane grooves 23 which support the vanes 30 forming a high pressure side pump chamber discharging high pressure oil. In contrast, low pressure oil is supplied from the outer-plate low pressure side through-hole 66 to the columnar grooves 232 of the vane grooves 23 which support the vanes 30 forming a low pressure side pump chamber discharging low pressure oil. In the vane pump 1 of the embodiment, this oil supply is realized by configurations described below in (5) and (6). (5) The outer-plate high pressure side recess portion 632 and the outer-plate low pressure side through-hole 66 are separated from each other between the high pressure side discharge port 4 and the low pressure side suction port 3 in the rotation direction. (6) The size of a separation portion between the outer-plate high pressure side recess portion 632 and the outer-plate low pressure side through-hole 66 in the rotation direction is set such that the outer-plate high pressure side recess portion 632 does not communicate with the outer-plate low pressure side through-hole 66 via the vane groove 23 positioned between the outer-plate high pressure side recess portion 632 and the outer-plate low pressure side through-hole 66.

That is, as illustrated in FIG. 16A, in the configuration described in (5), an outer-plate high pressure side recess portion downstream end 632*f*, which is a downstream end of the outer-plate high pressure side recess portion 632, is not continuous with an outer-plate low pressure side through-hole upstream end 66*e* which is an upstream end of the outer-plate low pressure side through-hole 66. An outer-plate low pressure side suction upstream separator 638 is positioned between the outer-plate high pressure side recess portion downstream end 632*f* and the outer-plate low pressure side through-hole upstream end 66*e* in the rotation direction. The outer-plate low pressure side suction upstream separator 638 between the outer-plate high pressure side recess portion 632 and the outer-plate low pressure side through-hole 66 is positioned in the rotation direction between a high pressure side discharge-recess portion downstream end 631*f*, which is a downstream end of the high pressure side discharge recess portion 631 of the outer plate 60 which forms the high pressure side discharge port 4, and a low pressure side suction cut-out upstream end 612*e* which is an upstream end of the low pressure side suction cut-out (a portion facing a pump chamber) 612 which forms the low pressure side suction port 3. As illustrated in FIG. 16B, the outer-plate low pressure side suction upstream separator 638 between the outer-plate high pressure side recess portion 632 and the outer-plate low pressure side through-hole 66 is positioned in the rotation direction between the high pressure side discharge-recess portion downstream end 443*f* (433*f*), which is a downstream end of the high pressure side discharge recess portion 443 (433) of the cam ring 40 which forms the high pressure side discharge port 4, and the low pressure side suction-recess portion upstream end 442*e* (432*e*) which is an upstream end of the low pressure side suction recess portion 442 (432) which forms the low pressure side suction port 3.

In the configuration described in (6), for example, the size of the outer-plate low pressure side suction upstream separator 638 in the rotation direction is larger than the size 232W of the columnar groove 232 of the vane groove 23 in the rotation direction. In other words, for example, the size of the outer-plate low pressure side suction upstream separator 638 in the rotation direction is set such that the outer-plate high pressure side recess portion 632 and the outer-plate low pressure side through-hole 66 do not extend to the columnar groove 232 of the vane groove 23. In this configuration, it is possible to prevent flowing of high pressure oil into the outer-plate low pressure side through-hole 66 via the vane groove 23, and flowing of high pressure oil into the columnar grooves 232 of the vane grooves 23 which support the vanes 30 forming the low pressure side pump chamber, which is caused by communication between the outer-plate high pressure side recess portion 632 and the outer-plate low pressure side through-hole 66 via the vane groove 23. Accordingly, contact pressure between the tip of the vane 30 of the low pressure side pump chamber and the inner circumferential cam ring surface 42 is decreased compared to a case in which high pressure oil flows into the columnar groove 232. As a result, the occurrence of torque loss is prevented. Leaking of oil from the columnar groove 232 into the low pressure side pump chamber on a tip side of the vane 30 is prevented. In addition, it is possible to prevent leaking of oil from the high pressure side pump chamber into the columnar groove 232 via the vane groove 23, which is caused by flowing of high pressure oil in the outer-plate high pressure side recess portion 632 into the outer-plate low pressure side through-hole 66 via the vane groove 23.

(Regarding Relationship Between Outer-Plate High Pressure Side Recess Portion 632 and Outer-Plate Low Pressure Side Recess Portion 633)

High pressure oil is supplied from the outer-plate high pressure side recess portion 632 to the columnar grooves 232 of the vane grooves 23 which support the vanes 30 forming a high pressure side pump chamber discharging high pressure oil. In contrast, low pressure oil is supplied from the outer-plate low pressure side recess portion 633 to the columnar grooves 232 of the vane grooves 23 which support the vanes 30 forming a low pressure side pump chamber discharging low pressure oil. In the vane pump 1 of the embodiment, this oil supply is realized by configurations described below in (7) and (8). (7) The outer-plate high pressure side recess portion 632 and the outer-plate low pressure side recess portion 633 are separated from each other between the low pressure side discharge port 5 and the high pressure side suction port 2 in the rotation direction. (8) The size of a separation portion between the outer-plate high pressure side recess portion 632 and the outer-plate low pressure side recess portion 633 in the rotation direction is set such that the outer-plate high pressure side recess portion 632 does not communicate with the outer-plate low pressure side recess portion 633 via the vane groove 23 positioned between the outer-plate high pressure side recess portion 632 and the outer-plate low pressure side recess portion 633.

That is, as illustrated in FIG. 16A, in the configuration described in (7), an outer-plate low pressure side recess portion downstream end 633*f*, which is a downstream end of the outer-plate low pressure side recess portion 633, is not continuous with an outer-plate high pressure side recess portion upstream end 632*e* which is an upstream end of the outer-plate high pressure side recess portion 632. An outer-plate high pressure side suction upstream separator 639 is positioned between the outer-plate low pressure side recess portion downstream end 633*f* and the outer-plate high pressure side recess portion upstream end 632*e* in the rotation direction. The outer-plate high pressure side suction upstream separator 639 between the outer-plate low pressure side recess portion 633 and the outer-plate high pressure side recess portion 632 is positioned in the rotation direction between a low pressure side discharge through-hole downstream end 65*f*, which is a downstream end of the low pressure side discharge through-hole 65 of the outer plate 60 which forms the low pressure side discharge port 5, and a high pressure side suction cut-out upstream end 611*e* which is an upstream end of the high pressure side suction cut-out (a portion facing a pump chamber) 611 which forms the high pressure side suction port 2. As illustrated in FIG. 16B, the outer-plate high pressure side suction upstream separator 639 between the outer-plate low pressure side recess portion 633 and the outer-plate high pressure side recess portion 632 is positioned in the rotation direction between the low pressure side discharge-recess portion downstream end 444*f* (434*f*), which is a downstream end of the low pressure side discharge recess portion 444 (434) of the cam ring 40 which forms the low pressure side discharge port 5, and the high pressure side suction-recess portion upstream end 441*e* (431*e*) which is an upstream end of the high pressure side suction recess portion 441 (431) forming the high pressure side suction port 2.

In the configuration described in (8), for example, the size of the outer-plate high pressure side suction upstream separator 639 in the rotation direction is larger than the size 232W of the columnar groove 232 of the vane groove 23 in the rotation direction. In other words, for example, the size of the outer-plate high pressure side suction upstream separator 639 in the rotation direction is set such that the outer-plate low pressure side recess portion 633 and the outer-plate high pressure side recess portion 632 do not extend to the columnar groove 232 of the vane groove 23. In this configuration, it is possible to prevent flowing of high pressure oil into the outer-plate low pressure side recess portion 633 via the vane groove 23, and flowing of high pressure oil into the columnar grooves 232 of the vane grooves 23 which support the vanes 30 forming the low pressure side pump chamber, which is caused by communication between the outer-plate low pressure side recess portion 633 and the outer-plate high pressure side recess portion 632 via the vane groove 23. Accordingly, contact pressure between the tip of the vane 30 of the low pressure side pump chamber and the inner circumferential cam ring surface 42 is decreased compared to a case in which high pressure oil flows into the columnar groove 232. As a result, the occurrence of torque loss is prevented. Leaking of oil from the columnar groove 232 into the low pressure side pump chamber on a tip side of the vane 30 is prevented. In addition, it is possible to prevent leaking of oil from the high pressure side pump chamber into the columnar groove 232 via the vane groove 23, which is caused by flowing of high pressure oil in the outer-plate high pressure side recess portion 632 into the outer-plate low pressure side recess portion 633 via the vane groove 23.

<Upper Limit Value of Size of Each of Inner-Plate Low Pressure Side Suction Upstream Separator 538, Inner-Plate High Pressure Side Suction Upstream Separator 539, Outer-Plate Low Pressure Side Suction Upstream Separator 638, and Outer-Plate High Pressure Side Suction Upstream Separator 639 in Rotation Direction>

Figure 17A:
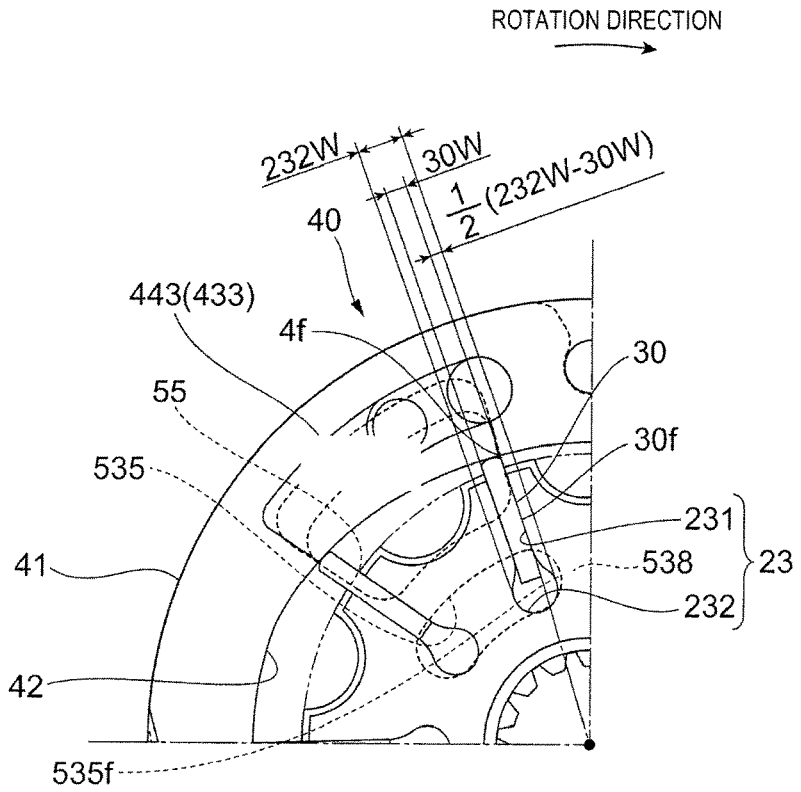
FIGS. 17A and 17B are views illustrating an upper limit value of the size of the inner-plate low pressure side suction upstream separator in the rotation direction.
Figure 17B:
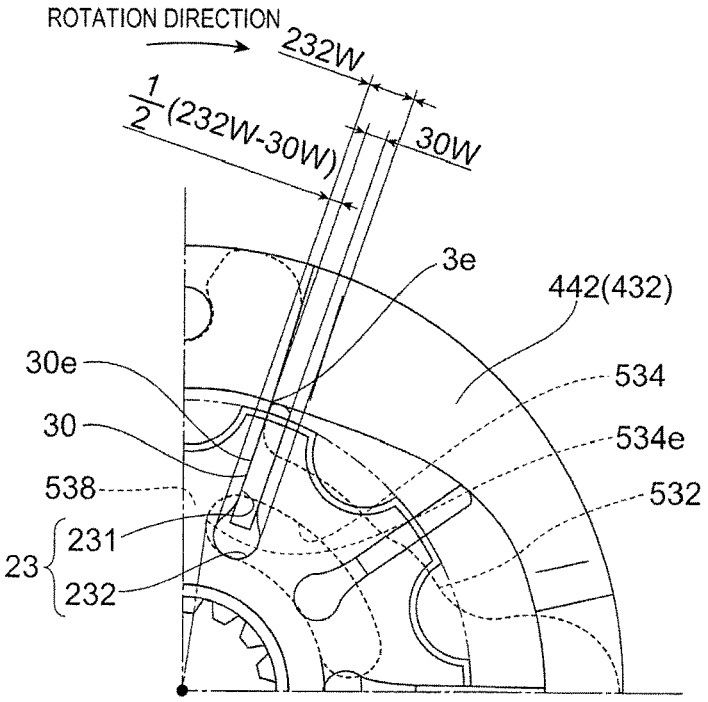

FIGS. 17A and 17B are views illustrating an upper limit value of the size of the inner-plate low pressure side suction upstream separator 538 in the rotation direction.

As illustrated in FIG. 17A, when a vane downstream end 30*f*, which is a downstream end of the vane 30, is positioned in the rotation direction at a high pressure side discharge-port downstream end 4*f* (most downstream point of an opening of the high pressure side discharge recess portion 433 (the high pressure side discharge recess portion 443) which is positioned to face the inner circumferential cam ring surface 42) which is a downstream end of the high pressure side discharge port 4, desirably, all of the columnar grooves 232 of the vane grooves 23 supporting the vane 30 communicate with the inner-plate high pressure side recess portion 535. That is, it is required that the inner-plate high pressure side recess portion downstream end 535*f* (that is, the downstream end of the inner-plate high pressure side recess portion 535) is positioned half ((232W−30W)/2) the distance (obtained by subtracting a size 30W of the vane 30 in the rotation direction from the size 232W of the columnar groove 232 of the vane groove 23 in the rotation direction) or greater downstream from the high pressure side discharge-port downstream end 4*f* which is the downstream end of the high pressure side discharge port 4. In this configuration, an outer end portion of the vane 30, which is positioned in a high pressure side pump chamber in the radial direction of rotation, is pushed by high pressure oil introduced into the columnar groove 232 of the vane groove 23, and thus, the tip of the vane 30 easily comes into contact with the inner circumferential cam ring surface 42. In a case where the size 232W of the columnar groove 232 of the vane groove 23 in the rotation direction is substantially the same as the size 30W of the vane 30 in the rotation direction, the inner-plate high pressure side recess portion downstream end 535*f*, which is the downstream end of the inner-plate high pressure side recess portion 535, may be substantially positioned at the high pressure side discharge-port downstream end 4*f* which is the downstream end of the high pressure side discharge port 4.

As illustrated in FIG. 17B, when a vane upstream end 30*e*, which is an upstream end of the vane 30, is positioned in the rotation direction at a low pressure side suction-port upstream end 3*e* (most upstream point of an opening of the low pressure side suction recess portion 432 (the low pressure side suction recess portion 442) which is positioned to face the inner circumferential cam ring surface 42) which is an upstream end of the low pressure side suction port 3, desirably, all of the columnar grooves 232 of the vane grooves 23 supporting the vane 30 communicate with the inner-plate low pressure side recess portion 534. That is, it is required that the inner-plate low pressure side recess portion upstream end 534*e* (that is, the upstream end of the inner-plate low pressure side recess portion 534) is positioned half ((232W−30W)/2) the distance (obtained by subtracting the size 30W of the vane 30 in the rotation direction from the size 232W of the columnar groove 232 of the vane groove 23 in the rotation direction) or greater upstream from the low pressure side suction-port upstream end 3*e* which is the upstream end of the low pressure side suction port 3. In this configuration, an outer end portion of the vane 30, which is positioned in a low pressure side pump chamber in the radial direction of rotation, is pushed by low pressure oil, and thus, the tip of the vane 30 easily comes into contact with the inner circumferential cam ring surface 42. In a case where the size 232W of the columnar groove 232 of the vane groove 23 in the rotation direction is substantially the same as the size 30W of the vane 30 in the rotation direction, the inner-plate low pressure side recess portion upstream end 534*e*, which is the upstream end of the inner-plate low pressure side recess portion 534, may be substantially positioned at the low pressure side suction-port upstream end 3*e* which is the upstream end of the low pressure side suction port 3.

Figure 18:
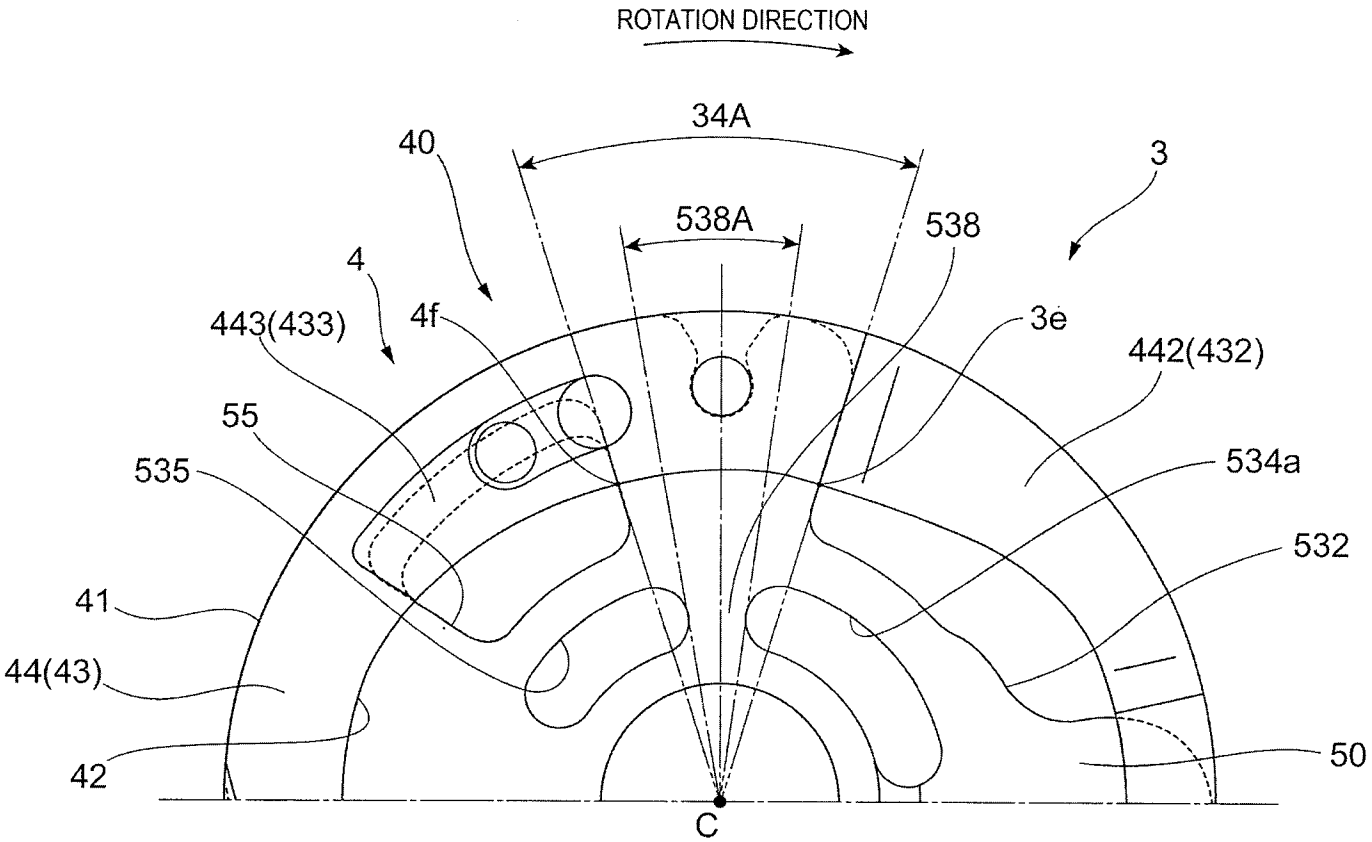
FIG. 18 is a view illustrating a relationship among the inner-plate low pressure side suction upstream separator, a high pressure side discharge port, and a low pressure side suction port.

FIG. 18 is a view illustrating a relationship among the inner-plate low pressure side suction upstream separator 538, the high pressure side discharge port 4, and the low pressure side suction port 3.

From the aforementioned description, when viewed in the direction of the rotation axis, desirably, a separation angle 538A of the inner-plate low pressure side suction upstream separator 538 in the rotation direction is smaller than or equal to a port-to-port angle 34A between the high pressure side discharge port 4 and the low pressure side suction port 3. In other words, desirably, the size 538W of the inner-plate low pressure side suction upstream separator 538 in the rotation direction is set to a value in the range of the port-to-port angle 34A between the high pressure side discharge port 4 and the low pressure side suction port 3 in the rotation direction. More specifically, desirably, the separation angle 538A of the inner-plate low pressure side suction upstream separator 538 is smaller than or equal to the port-to-port angle 34A between the high pressure side discharge-port downstream end 4*f*, which is the downstream end of the high pressure side discharge port 4, and the low pressure side suction-port upstream end 3*e* which is the upstream end of the low pressure side suction port 3. When viewed in the direction of the rotation axis, the port-to-port angle 34A between the high pressure side discharge-port downstream end 4*f* and the low pressure side suction-port upstream end 3*e* in the rotation direction is an acute angle that is formed by a line connecting the high pressure side discharge-port downstream end 4*f* and the rotation center C, and a line connecting the low pressure side suction-port upstream end 3*e* and the rotation center C.

For the same reason, when viewed in the direction of the rotation axis, desirably, the rotation angle of the outer-plate low pressure side suction upstream separator 638 is smaller than or equal to the angle between the high pressure side discharge-port downstream end 4*f*, which is the downstream end of the high pressure side discharge port 4, and the low pressure side suction-port upstream end 3*e* which is the upstream end of the low pressure side suction port 3.

When the vane downstream end 30*f*, which is the downstream end of the vane 30, is positioned at a low pressure side discharge-port downstream end (not illustrated) (most downstream point of an opening of the low pressure side discharge recess portion 434 (the low pressure side discharge recess portion 444) which is positioned to face the inner circumferential cam ring surface 42) which is a downstream end of the low pressure side discharge port 5, desirably, all of the columnar grooves 232 of the vane grooves 23 supporting the vanes 30 communicate with the inner-plate low pressure side recess portion 534. That is, it is required that the inner-plate low pressure side recess portion downstream end 534*f* (refer to FIGS. 14A and 14B) (that is, the downstream end of the inner-plate low pressure side recess portion 534) is positioned half ((232W−30W)/2) the distance (obtained by subtracting the size 30W of the vane 30 in the rotation direction from the size 232W of the columnar groove 232 of the vane groove 23 in the rotation direction) or greater downstream from the low pressure side discharge-port downstream end which is the downstream end of the low pressure side discharge port 5. In this configuration, an outer end portion of the vane 30, which is positioned in a low pressure side pump chamber in the radial direction of rotation, is pushed by low pressure oil introduced into the columnar groove 232 of the vane groove 23, and thus, the tip of the vane 30 easily comes into contact with the inner circumferential cam ring surface 42. In a case where the size 232W of the columnar groove 232 of the vane groove 23 in the rotation direction is substantially the same as the size 30W of the vane 30 in the rotation direction, the inner-plate low pressure side recess portion downstream end 534*f*, which is the downstream end of the inner-plate low pressure side recess portion 534, may be substantially positioned at the low pressure side discharge-port downstream end which is the downstream end of the low pressure side discharge port 5.

When the vane upstream end 30*e*, which is the upstream end of the vane 30, is positioned at a high pressure side suction-port upstream end (not illustrated) (most upstream point of an opening of the high pressure side suction recess portion 431 (the high pressure side suction recess portion 441) which is positioned to face the inner circumferential cam ring surface 42) which is an upstream end of the high pressure side suction port 2, desirably, all of the columnar grooves 232 of the vane grooves 23 supporting the vane 30 communicate with the inner-plate high pressure side through-hole 56. That is, it is required that the inner-plate high pressure side through-hole upstream end 56*e* (refer to FIGS. 14A and 14B) (that is, the upstream end of the inner-plate high pressure side through-hole 56) is positioned half ((232W−30W)/2) the distance (obtained by subtracting the size 30W of the vane 30 in the rotation direction from the size 232W of the columnar groove 232 of the vane groove 23 in the rotation direction) or greater upstream from the high pressure side suction-port upstream end which is the upstream end of the high pressure side suction port 2. In this configuration, an outer end portion of the vane 30, which is positioned in a high pressure side pump chamber in the radial direction of rotation, is pushed by high pressure oil, and thus, the tip of the vane 30 easily comes into contact with the inner circumferential cam ring surface 42. In a case where the size 232W of the columnar groove 232 of the vane groove 23 in the rotation direction is substantially the same as the size 30W of the vane 30 in the rotation direction, the inner-plate high pressure side through-hole upstream end 56*e*, which is the upstream end of the inner-plate high pressure side through-hole 56, may be substantially positioned at the high pressure side suction-port upstream end which is the upstream end of the high pressure side suction port 2.

From the aforementioned description, when viewed in the direction of the rotation axis, desirably, the rotation angle of the inner-plate high pressure side suction upstream separator 539 is smaller than or equal to an angle between the low pressure side discharge port 5 and the high pressure side suction port 2. In other words, desirably, the size of the inner-plate high pressure side suction upstream separator 539 in the rotation direction is set to a value in the range of the angle between the low pressure side discharge port 5 and the high pressure side suction port 2. More specifically, desirably, the rotation angle of the inner-plate high pressure side suction upstream separator 539 is smaller than or equal to the angle between the low pressure side discharge-port downstream end, which is the downstream end of the low pressure side discharge port 5, and the high pressure side suction-port upstream end which is the upstream end of the high pressure side suction port 2. When viewed in the direction of the rotation axis, the angle between the low pressure side discharge-port downstream end and the high pressure side suction-port upstream end is an acute angle that is formed by a line connecting the low pressure side discharge-port downstream end and the rotation center C, and a line connecting the high pressure side suction-port upstream end and the rotation center C.

For the same reason, when viewed in the direction of the rotation axis, desirably, the rotation angle of the outer-plate high pressure side suction upstream separator 639 is smaller than or equal to the angle between the low pressure side discharge-port downstream end, which is the downstream end of the low pressure side discharge port 5, and the high pressure side suction-port upstream end which is the upstream end of the high pressure side suction port 2.

In the pump of the embodiment, (1) the inner-plate high pressure side recess portion 535 and the inner-plate low pressure side recess portion 534 are separated from each other between the high pressure side discharge port 4 and the low pressure side suction port 3, (3) the inner-plate high pressure side through-hole 56 and the inner-plate low pressure side recess portion 534 are separated from each other between the low pressure side discharge port 5 and the high pressure side suction port 2, (5) the outer-plate high pressure side recess portion 632 and the outer-plate low pressure side through-hole 66 are separated from each other between the high pressure side discharge port 4 and the low pressure side suction port 3, and (7) the outer-plate high pressure side recess portion 632 and the outer-plate low pressure side recess portion 633 are separated from each other between the low pressure side discharge port 5 and the high pressure side suction port 2. These separations are realized and the pressure of oil is increased to two different pressures by forming the inner circumferential cam ring surface 42 of the cam ring 40 into different shapes, instead of forming the high and low pressure side suction ports and the high and low pressure side discharge ports into different shapes. However, the present invention is not limited to this type of pump. For example, the present invention may be applied to a type of pump in which passage resistance of oil discharged from pump chambers, for example, the shape of a discharge port is changed to increase the pressure of oil to two different pressures instead of the shape of the inner circumferential cam ring surface 42 of the cam ring 40 being changed.

<Regarding Passage of Oil Discharged from Pump Unit>

The vane pump 1 of the embodiment includes the rotation shaft 10, and the pump unit 70 that discharges oil at multiple discharge pressures, discharges oil (high pressure oil) to the one side in an axial direction (direction of the rotation axis) of the rotation shaft 10 at a first discharge pressure of the multiple discharge pressures, and discharges oil (low pressure oil) to the other side in the direction of the rotation axis at a second discharge pressure of the multiple discharge pressures. More specifically, the pump unit 70 discharges high pressure oil to the one side in the direction of the rotation axis via the high pressure side discharge through-hole 55 of the inner plate 50 (refer to FIG. 12), and discharges low pressure oil to the other side in the direction of the rotation axis via the low pressure side discharge through-hole 65 of the outer plate 60 (refer to FIG. 13). In other words, the pump unit 70 discharges high pressure oil to a bottom portion side of the case 110 via the high pressure side discharge through-hole 55 of the inner plate 50 (refer to FIG. 12), and discharges low pressure oil to a cover 120 side via the low pressure side discharge through-hole 65 of the outer plate 60 (refer to FIG. 13). The vane pump 1 discharges high pressure oil, which has been discharged from the pump unit 70, to the outside from the high pressure side discharge outlet 117 via the space S2 (the high pressure side discharge passage R2) (refer to FIG. 4) that is positioned closer to the bottom portion side of the case 110 than the inner plate fitting portion 112. The vane pump 1 discharges low pressure oil, which has been discharged from the pump unit 70, to the outside from the low pressure side discharge outlet 118 via the cover low pressure side discharge passage R4 (refer to FIG. 5) formed by the cover low pressure side discharge-recess portion 122 and the like, and via the case low pressure side discharge passage R3 (refer to FIG. 5) formed by the case outer recess portion 115.

As such, in the vane pump 1 of the embodiment, the pump unit 70 discharges high pressure oil to the one side in the direction of the rotation axis (to the case 110 side), and discharges low pressure oil to the other side in the direction of the rotation axis (to the cover 120 side). For this reason, the vane pump 1 can discharge high pressure oil to the outside via the high pressure side discharge passage R2 formed in the case 110, and discharge low pressure oil to the outside via the cover low pressure side discharge passage R4 formed mainly in the cover 120. As a result, the vane pump 1 can be more compact in comparison with that having a configuration in which the pump unit 70 discharges high pressure oil and low pressure oil to the same direction (to either the case 110 side or the cover 120 side). That is, in the configuration in which the pump unit 70 discharges high pressure oil and low pressure oil to the same direction (to either the case 110 side or the cover 120 side), the case 110 or the cover 120, to which high pressure oil and low pressure oil is discharged, has to be provided with both of a passage of the high pressure oil and a passage of the low pressure oil. For this reason, the size of the case 110 or the cover 120, to which high pressure oil and low pressure oil are discharged, increases in at least one of the direction of the rotation axis and the radial direction of rotation. In the vane pump 1 of the embodiment, the pump unit 70 discharges high pressure oil to the one side in the direction of the rotation axis, and discharges low pressure oil to the other side in the direction of the rotation axis, and thus, the vane pump 1 can be compact.

In the vane pump 1 of the embodiment, oil is suctioned into the housing 100 via the suction inlet 116 formed in the case 110, and oil is suctioned into the pump unit 70 via the high pressure side suction port 2 and the low pressure side suction port 3. The oil, which has been suctioned from the suction inlet 116 formed in the case 110, is suctioned into pump chambers of the pump unit 70 via the suction passage R1 which is formed by the space S1 that is positioned closer to the opening side of the case 110 than the inner plate fitting portion 112, the cover suction-recess portion 125 of the cover 120, and the like. The vane pump 1 of the embodiment is capable of suctioning a larger amount of oil than that in a case where oil is suctioned into the pump unit 70 via the space S2 which is positioned closer to the bottom portion side of the case 110 than the inner plate fitting portion 112, and is positioned at the periphery of the case bearing 111. In other words, since the amount of high pressure oil discharged from the pump unit 70 is smaller than the amount of oil suctioned into the pump unit 70, the high pressure side discharge passage R2 of high pressure oil discharged from the pump unit 70 can be formed by the space S2 narrower than the space S1. Accordingly, in the vane pump 1 of the embodiment, it is possible to further decrease the volume of the space S2, and to further decrease the sizes of the case 110 in the direction of the rotation axis and the radial direction of rotation in comparison with that having a configuration in which oil is suctioned into the pump unit 70 via the space S2. As a result, the vane pump 1 of the embodiment can be compact.

<Regarding Amount of Oil Discharged from Pump Unit and Passage Length>

The pump unit 70 of the embodiment includes the high pressure side discharge through-hole 55 of the inner plate 50 that is an example of a first discharge portion discharging oil of a small amount which is an example of a first amount, and the low pressure side discharge through-hole 65 of the outer plate 60 that is an example of a second discharge portion discharging oil of a large amount which is an example of a second amount larger than the first amount. In other words, the pump unit 70 discharges a small amount of high pressure oil from the high pressure side discharge through-hole 55 of the inner plate 50, and discharges a large amount of low pressure oil from the low pressure side discharge through-hole 65 of the outer plate 60.

The housing 100 of the embodiment includes the high pressure side discharge outlet 117 that is an example of a first discharge outlet through which oil discharged from the high pressure side discharge through-hole 55 of the pump unit 70 is discharged to the outside, and the low pressure side discharge outlet 118 that is an example of a second discharge outlet through which oil discharged from the low pressure side discharge through-hole 65 of the pump unit 70 is discharged to the outside. In the housing 100, the high pressure side discharge passage R2 (refer to FIG. 4), which is an example of a first passage, is formed between the high pressure side discharge through-hole 55 and the high pressure side discharge outlet 117 of the pump unit 70, and the cover low pressure side discharge passage R4 (refer to FIG. 5) and the case low pressure side discharge passage R3 (refer to FIG. 5), which are examples of a second passage, are formed between the low pressure side discharge through-hole 65 and the low pressure side discharge outlet 118 of the pump unit 70.

Figure 19:
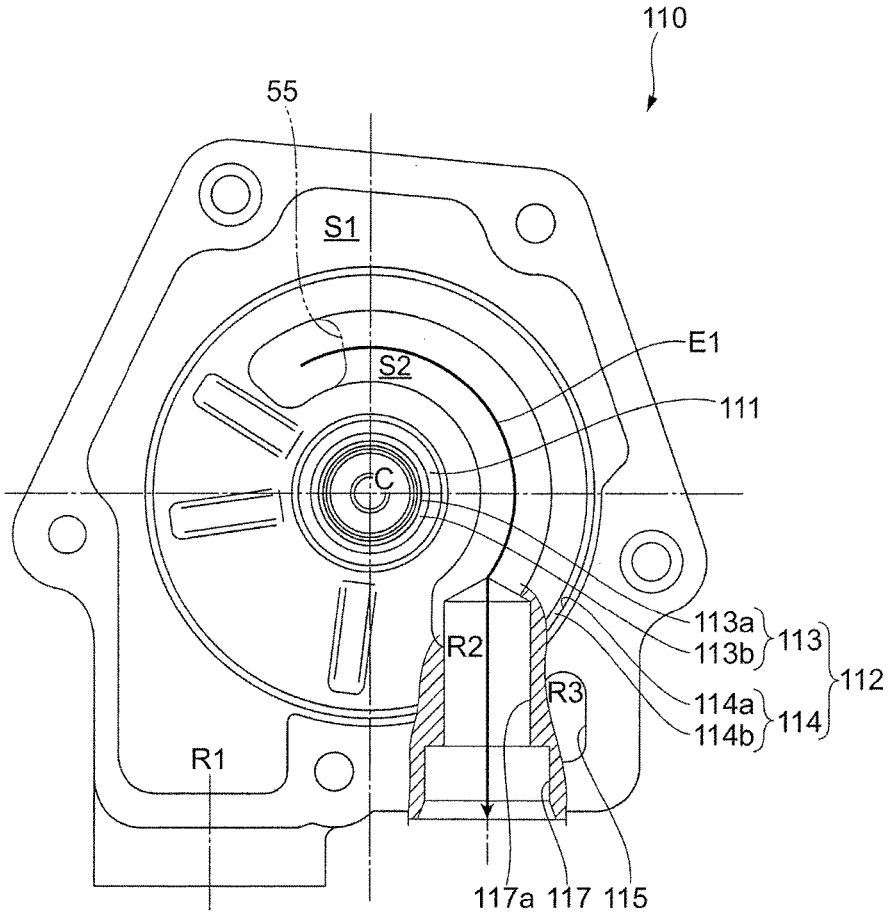
FIG. 19 is a view of a high pressure side discharge passage viewed from the one side in the direction of the rotation axis.

FIG. 19 is a view of the high pressure side discharge passage viewed from the one side in the direction of the rotation axis.

As illustrated in FIG. 19, the high pressure side discharge through-hole 55 of the pump unit 70 and the high pressure side discharge outlet 117 formed in the case 110 of the housing 100 are present opposite to each other in a state where the rotation center C is interposed therebetween. The high pressure side discharge passage R2 is mainly formed by the space S2 which is positioned closer to the bottom portion side of the case 110 than the inner plate fitting portion 112, and is positioned at the periphery of the case bearing 111, and a communication hole 117*a* through which the space S2 communicates with the high pressure side discharge outlet 117. Accordingly, the flow pattern of high pressure oil in the high pressure side discharge passage R2 viewed from the one side in the direction of the rotation axis is illustrated by an arrow E1 in FIG. 19.

Figure 20B:
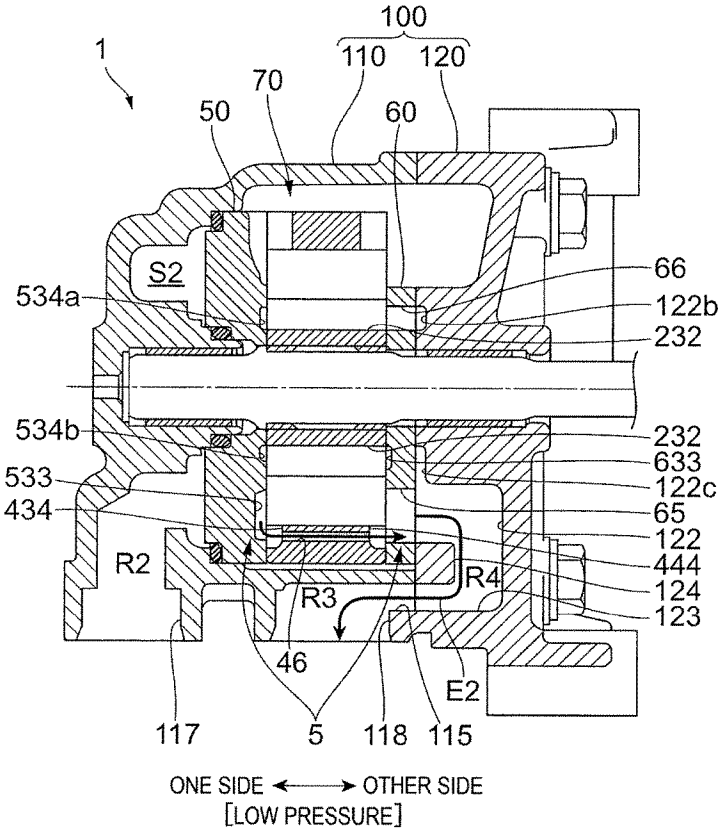
FIG. 20B is a view in which the cover low pressure side discharge passage and a case low pressure side discharge passage are illustrated on a plane containing a central line of a rotation shaft.
Figure 20A:
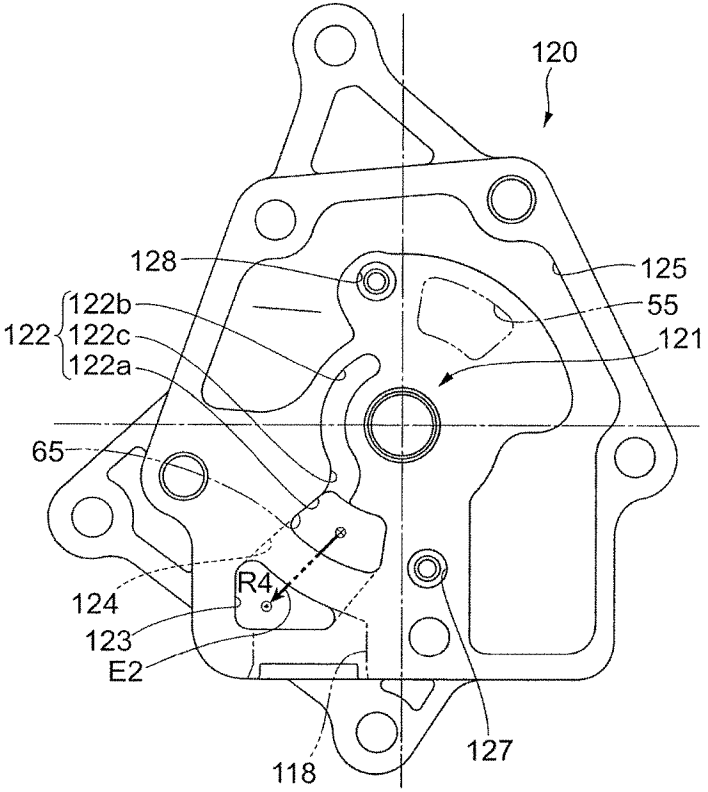
FIG. 20A is a view of a cover low pressure side discharge passage viewed from the other side in the direction of the rotation axis.

FIG. 20A is a view of the cover low pressure side discharge passage viewed from the other side in the direction of the rotation axis. FIG. 20B is a view in which the cover low pressure side discharge passage and the case low pressure side discharge passage are illustrated on a plane containing a central line of the rotation shaft As illustrated in FIGS. 20A and 20B, the cover low pressure side discharge-recess portion 122, the cover recess portion connection portion 124, and the cover outer recess portion 123, which are provided in the cover 120, form the cover low pressure side discharge passage R4 (refer to FIG. 5) of oil discharged from the low pressure side discharge through-hole 65 of the pump unit 70. As illustrated in FIG. 20B, the case outer recess portion 115 forms the case low pressure side discharge passage R3 of oil discharged from the low pressure side discharge through-hole 65 of the pump unit 70. Accordingly, the flow pattern of low pressure oil in the cover low pressure side discharge passage R4 and the case low pressure side discharge passage R3 is illustrated by an arrow E2 in FIG. 20B.

As illustrated in FIG. 20A, the first cover low pressure side discharge-recess portion 122*a*, which is formed at a position facing the low pressure side discharge through-hole 65 of the pump unit 70, and the low pressure side discharge outlet 118, which is formed in the case 110 of the housing 100, are present opposite to the high pressure side discharge through-hole 55 of the pump unit 70 in a state where the rotation center C is interposed therebetween. That is, the low pressure side discharge through-hole 65 of the pump unit 70 is positioned closer to the low pressure side discharge outlet 118 than the high pressure side discharge through-hole 55 of the pump unit 70. As illustrated in FIG. 20B, the low pressure side discharge through-hole 65 of the pump unit 70 is positioned closer to the low pressure side discharge outlet 118 than the high pressure side discharge outlet 117 formed in the case 110.

If the arrow E1 illustrating the flow pattern of high pressure oil in FIG. 19 is compared to the arrow E2 illustrating the flow pattern of low pressure oil in FIG. 20B, the arrow E2 illustrating the flow pattern of low pressure oil is shorter. In other words, the distance from the low pressure side discharge through-hole 65 of the pump unit 70 to the low pressure side discharge outlet 118 formed in the case 110 is shorter than the distance from the high pressure side discharge through-hole 55 of the pump unit 70 to the high pressure side discharge outlet 117 formed in the case 110 of the housing 100. That is, in the vane pump 1 of the embodiment, the cover low pressure side discharge passage R4 and the case low pressure side discharge passage R3 are shorter than the high pressure side discharge passage R2. For this reason, the vane pump 1 of the embodiment is capable of smoothly discharging a large amount of low pressure oil, which has been discharged from the low pressure side discharge through-hole 65 of the pump unit 70, to the outside of the housing 100 via the low pressure side discharge outlet 118.

Since the amount of high pressure oil, which has been discharged from the high pressure side discharge through-hole 55 of the pump unit 70 and flows through the high pressure side discharge passage R2 that is longer than the cover low pressure side discharge passage R4 and the case low pressure side discharge passage R3, is small, and the pressure of the high pressure oil is higher than that of low pressure oil discharged from the low pressure side discharge through-hole 65, even if the distance from the high pressure side discharge through-hole 55 to the high pressure side discharge outlet 117 is long, the high pressure oil can be smoothly discharged to the outside of the housing 100.

<Shape of Housing>

FIG. 1 is an exterior view of the vane pump 1 viewed from the direction perpendicular to the direction of the rotation axis of the rotation shaft 10.

As illustrated in FIG. 1, in the housing 100 of the embodiment, the high pressure side discharge outlet 117, through which oil discharged from the high pressure side discharge through-hole 55 of the pump unit 70 is discharged to the outside, and the low pressure side discharge outlet 118, through which oil discharged from the low pressure side discharge through-hole 65 of the pump unit 70 is discharged to the outside, are formed to face the same direction. As illustrated in FIG. 1, in the housing 100 of the embodiment, the suction inlet 116 through which oil is suctioned into the pump unit 70 is formed to face the same direction as the direction of the high pressure side discharge outlet 117 and the low pressure side discharge outlet 118. That is, when viewed from the direction perpendicular to the direction of the rotation axis of the rotation shaft 10, the openings of the high pressure side discharge outlet 117, the low pressure side discharge outlet 118, and the suction inlet 116 are illustrated on the same drawing sheet as illustrated in FIG. 1. In other words, the high pressure side discharge outlet 117, the low pressure side discharge outlet 118, and the suction inlet 116 are formed on the same side surface 110*a* of the case 110 of the housing 100.

The directions (columnar directions) of the respective columnar holes of the high pressure side discharge outlet 117, the low pressure side discharge outlet 118, and the suction inlet 116 are the same. That is, the direction in which oil is discharged via the high pressure side discharge outlet 117 is the same as that in which oil is discharged via the low pressure side discharge outlet 118. The direction in which oil is suctioned via the suction inlet 116 is opposite to the direction in which oil is discharged via the high pressure side discharge outlet 117 and the low pressure side discharge outlet 118.

As a result, in the vane pump 1 of the embodiment, all guide members (pipes, tubes, or the like) which guide oil can be connected to the suction inlet 116, the high pressure side discharge outlet 117, and the low pressure side discharge outlet 118 in the same direction. In a case where guide members (pipes, tubes, or the like) are inserted into the suction inlet 116, the high pressure side discharge outlet 117, and the low pressure side discharge outlet 118, all the guide members may be inserted thereinto from the front surface toward the rear surface of the drawing sheet of FIG. 1. In contrast, in a case where at least any one of the suction inlet 116, the high pressure side discharge outlet 117, and the low pressure side discharge outlet 118 is formed to face a direction different from that of the other ports (on a side surface different from the surface on which the other ports are formed), it is difficult to connect all guide members in the same direction. It is necessary to insert a guide member, which is connected to at least any one of the suction inlet 116, the high pressure side discharge outlet 117, and the low pressure side discharge outlet 118 which is formed to face the direction different from that of the other ports, thereinto in a direction different from the direction leading from the front surface toward the rear surface of the drawing sheet of FIG. 1, that is, from the rear surface toward the front surface of the drawing sheet of FIG. 1 or from the top toward the bottom of the drawing sheet of FIG. 1.

In the vane pump 1 of the embodiment, at least the high pressure side discharge outlet 117 and the low pressure side discharge outlet 118 are formed in the housing 100 so as to face the same direction, and thus, it is possible to easily assemble guide members (pipes, tubes, or the like) thereto.

In the housing 100 of the embodiment, all the suction inlet 116, the high pressure side discharge outlet 117, and the low pressure side discharge outlet 118 are formed in the case 110. Accordingly, the shape of the cover 120 can be further simplified than that in a case where any one of the suction inlet 116, the high pressure side discharge outlet 117, and the low pressure side discharge outlet 118 is formed in the cover 120. As a result, a molding die for molding the cover 120 can be configured with a pair of dies which are moved opposite to each other in the direction of the rotation axis, and thus, it is possible to decrease the manufacturing cost of the cover 120.

All the suction inlet 116, the high pressure side discharge outlet 117, and the low pressure side discharge outlet 118 are formed in the case 110 (the side surface 110*a*) so as to face the same direction. Accordingly, it is possible to further decrease the manufacturing cost of the case 110 than that in a case where any one of the suction inlet 116, the high pressure side discharge outlet 117, and the low pressure side discharge outlet 118 is formed in the case 110 (in a side surface different from the side surface 110*a*) so as to face a different direction. That is, in a case where all the suction inlet 116, the high pressure side discharge outlet 117, and the low pressure side discharge outlet 118 are formed in the case 110 (the side surface 110*a*) so as to face the same direction, a molding die of the case 110 can be configured with a pair of dies which are moved opposite to each other in the direction of the rotation axis, and one die which is slid in the direction (columnar direction) of the columnar hole of the suction inlet 116 or the like. In contrast, in a case where any one of the suction inlet 116, the high pressure side discharge outlet 117, and the low pressure side discharge outlet 118 is formed to face a direction different from that of the other ports (in a side surface different from the side surface 110*a*), it is necessary to prepare a die that is slid in the direction (columnar direction) of the columnar hole of any one of the suction inlet 116, the high pressure side discharge outlet 117, and the low pressure side discharge outlet 118 which is formed to face the direction different from that of the other ports. As a result, it is possible to decrease the manufacturing cost of the case 110 in the vane pump 1 of the embodiment.

In the embodiment, the aforementioned discharge directions of high pressure oil and low pressure oil, the aforementioned difference between the length of the passage of high pressure oil and the length of the passage of low pressure oil, and the aforementioned shape of the housing 100 in the vane pump 1 are applied to a type of pump in which the shape of the inner circumferential cam ring surface 42 of the cam ring 40 is changed to increase the pressure of oil to two different pressures instead of different suction ports and discharge ports on high and low pressure sides being provided. However, the application of the present invention is not specifically limited to this type of pump. For example, the present invention may be applied to a type of pump in which passage resistance of oil discharged from pump chambers, for example, the shape of a discharge port is changed to increase the pressure of oil to two different pressures instead of the shape of the inner circumferential cam ring surface 42 of the cam ring 40 being changed.

The invention claimed is:

1. A vane pump device comprising:

a pump unit that includes a first discharge portion which discharges a working fluid at a first discharge pressure, and a second discharge portion which discharges the working fluid at a second discharge pressure lower than the first discharge pressure; and a housing which accommodates the pump unit, and includes a first discharge outlet through which the working fluid discharged from the first discharge portion of the pump unit is discharged to an outside, and a second discharge outlet through which the working fluid discharged from the second discharge portion is discharged to the outside, wherein the first discharge outlet and the second discharge outlet are formed to face the same direction, and the first discharge outlet and the second discharge outlet open in a direction perpendicular to an axial direction of a rotation shaft.

2. The vane pump device according to claim 1, wherein a suction inlet through which the working fluid is suctioned into the pump unit is formed in the housing to face the same direction as the direction of the first discharge outlet and the second discharge outlet.

3. The vane pump device according to claim 2, wherein the housing includes a case, and a cover covering an opening of the case, and wherein the first discharge outlet, the second discharge outlet, and the suction inlet are formed in the case.

4. The vane pump device according to claim 2, wherein the direction in which the working fluid is discharged to the outside via the first discharge outlet and the second discharge outlet of the housing is opposite to the direction in which the working fluid is suctioned via the suction inlet.

5. The vane pump device according to claim 1, wherein the pump unit discharges the working fluid of a first amount via the first discharge portion, and discharges the working fluid of a second amount larger than the first amount via the second discharge portion.

6. The vane pump device according to claim 1, wherein the pump unit includes multiple vanes, a rotor that supports the vanes so that the vanes can move in a radial direction of rotation, and that rotates due to a rotating force received from the rotation shaft, a cam ring that includes an inner circumferential surface facing an outer circumferential surface of the rotor, and is disposed to surround the rotor, a one side member that is disposed on one end portion side of the cam ring in the axial direction of the rotation shaft to cover an opening of the cam ring, and another side member that is disposed on the other end portion side of the cam ring in the axial direction to cover another opening of the cam ring, and wherein the first discharge portion is a through-hole formed in the one side member, and the second discharge portion is a through-hole formed in the other side member.

7. The vane pump device according to claim 6, wherein the pump unit includes multiple pump chambers which discharge the working fluid via the first discharge portion at the first discharge pressure, and discharge the working fluid via the second discharge portion at the second discharge pressure lower than the first discharge pressure during one revolution of the rotation shaft, and each of the multiple pump chambers is formed by two adjacent vanes, the outer circumferential surface of the rotor, the inner circumferential surface of the cam ring, the one side member, and the other side member.

8. The vane pump device according to claim 1, wherein the working fluid is discharged from the first discharge portion in the direction perpendicular to the axial direction of the rotation shaft.

9. The vane pump device according to claim 1, wherein the first discharge outlet and the second discharge outlet open on a plane that extends parallel to the axial direction of the rotation shaft.

* * * * *